US006238144B1

(12) United States Patent
Babcock

(10) Patent No.: US 6,238,144 B1
(45) Date of Patent: May 29, 2001

(54) RETAINING WALL AND FASCIA SYSTEM

(76) Inventor: John W. Babcock, 510 S. 7500 East, Huntsville, UT (US) 84317

( * ) Notice: Subject to any disclaimer, the term of this patent is extended or adjusted under 35 U.S.C. 154(b) by 0 days.

(21) Appl. No.: 08/848,068

(22) Filed: Apr. 28, 1997

(51) Int. Cl.[7] ..... E02D 29/02
(52) U.S. Cl. ..... 405/284; 405/262
(58) Field of Search ..... 405/262, 284, 405/285, 286, 287

(56) References Cited

U.S. PATENT DOCUMENTS 1,761,614 * 6/1930 Collier ..... 405/285
3,381,483 * 5/1968 Huthsing, Jr. ..... 405/285
4,050,254 * 9/1977 Meheen et al. ..... 405/285
4,756,645 * 7/1988 Balzer ..... 405/284
5,158,399 * 10/1992 Flores ..... 405/285
5,456,554 * 10/1995 Barrett et al. ..... 405/262
5,468,098 * 11/1995 Babcock ..... 405/262
5,533,839 * 7/1996 Shimada ..... 405/286

FOREIGN PATENT DOCUMENTS

51522 * 3/1988 (JP) ..... 405/262
268815 * 11/1988 (JP) ..... 405/262
297626 * 12/1988 (JP) ..... 405/262

* cited by examiner

*Primary Examiner*—Tamara Graysay
*Assistant Examiner*—Frederick L. Lagman

(57) ABSTRACT

A full height, elevated base, pre-manufactured, retaining wall facing system attached to a separate closed face mechanically stabilized earth retention structure Incorporating a continuous closure beam at the top interface of the panel facing and the separate mechanically stabilized earth retention structure.

26 Claims, 20 Drawing Sheets

RETAINING WALL AND FASCIA SYSTEM

FIELD OF THE INVENTION

The present invention relates generally to retaining wall systems and more specifically to a retaining wall system which includes fie rod assemblies for attaching the wall facing elements with a reduced height, compared to the overall wall height, to the confined fill layers of a separate stabilized earth (MSE) structure.

BACKGROUND OF THE INVENTION

Various methods have been used in the past to construct precast walls for retaining earth, soil, sand or other fill generally referred to as soil. As typical precast wall system is disclosed in U.S. Pat. No. 4,914,876 assigned to the Keystone Retaining Wall Systems Inc. by Paul J. Forsberg. The Keystone Patent illustrates a typical modular block wall system wherein the wall face is comprised of concrete masonry units connected to the geosynthetic wall reinforcement layers. The geosynthetic tensile inclusion members for this type of retaining wall structure are typical referred to as "geogrids".

A disadvantage of such a system is that a considerable amount of hand labor is required to install the numerous small block facing units. This limits the amount of wall structure that can be completed in any work shift. In addition, if the wall is placed on weak foundation soils, the manifestation of wall settlement is cracking or more significant crushing or crumbling of the facing units. If the settlement is excessive, the geogrid material can be sheared at the concrete masonry unit horizontal joints which can result in wall failures.

Numerous other types of concrete block mechanically stabilized earth (MSE) wall systems are available. All of these products, such as the Keystone wall type previously described, mandates precise grading and compacting of the wall backfill to correspond to increments of the vertical height of the block facing units so that the tensile inclusion material used to mechanically reinforce the retained wall backfill material will be at the horizontal joint elevation of the concrete masonry units. Although the material costs for these types of wall systems are low, due to the high labor costs of various stages of the wall construction for the these systems the resultant installed price of walls constructed with these products can be substantially higher than the material costs.

Another broad range of mechanically stabilized walls include walls that use precast concrete panels for the wall facing elements such as walls that utilize components provided by the Reinforced Earth Company of Arlington VA. U.S. Pat. No. 4,961,673 issued to Pagano et al. along with U.S. Pat. Nos. 3,421,326; 3,686,873; 4,0425,965 and 4,116,010 to Vidal describe such a wall system. Wall systems such as the Reinforced Earth products and those of the VSL Company, U.S. Pat. No. 4,725,170 by Edgar Davis, require the use of metal reinforcing strips or steel grids to be used as soil inclusion members in the wall backfill and to be connected to the precast wall panels to hold the panels in place and to provide stability for the wall backfill.

All of these types of wall systems require that the facing panels be placed on a continuous cast in place leveling pod. The elevation of the foundation pad for these systems corresponds to the base elevation of the MSE wall structure. The base of all retaining walls, either cast- in-place or MSE, is typically required to be depressed with respect to the final: grade in the front if the wall for geotechnical stability or for frost protection. Heretofore all wall systems currently in use have a bottom of wall facing elevation that corresponds to the bottom or base elevation of the MSE reinforcement elevation. In addition the facing elements of these systems are required to be installed simultaneously with the placement of the wall backfill and soil reinforcement.

A disadvantage of MSE walls that use metal soil reinforcement is that the metal soil tensile inclusion members used are subject to corrosion since the metal is in direct contact with the wall backfill. Numerous catastrophic failures have resulted from the effects of unchecked corrosion on the metal tensile inclusion members for these types of wall systems. Although the metal strips or steel grids can be galvanized to reduce the effects of the oxidation process this technique is not effective for all soil types due to the diverse mineral content present in some soils. Other methods such as epoxy coating for the metal soil reinforcing members have been used to further resist the deleterious effects of potential chemical reactions of the minerals present in the soil in contact with the soil reinforcement. A disadvantage of the epoxy coating is that the coating is easily scratched during the construction process which result in the exposure of the steel or metal soil reinforcement to the corrosive effects of the minerals present in the backfill. Also, epoxy coatings increase the costs of these systems.

Since the wall facing components in all precast panel or concrete masonry unit wall systems currently in use are installed simultaneously with the wall backfill, another disadvantage of these systems, besides the need for close backfill placement tolerances, is the fact that a portion of the soil mass adjacent to the wall facing units does exert a horizontal force on the face.

Typical wall facing units for existing MSE systems in current use may range in size from 8"×16" for block systems to 25 to 50 sq. ft. for precast panel wall systems. The concrete masonry block systems, due to the high unit weight and relatively small size of each block, do not require bracing or interlocking to hold the face units in a vertical position as the wall backfill is placed. Since the blocks are heavy (exceeding 100 pounds for some applications) the placement of the blocks is physically demanding which adds to the placement cost of the facing units. For currently available MSE wall systems that use panels for facing units the panels are large in size compared to the block facing units and the panels (typically between 25 to 80 sq. ft. in area) are held in place during backfilling operations by interlocking with the previously placed or adjacent panels. For some systems the facing units are "wedged" or leaned by other methods so that the effect of the interaction of the backfill pressure and the metal soil reinforcement will, in theory, force the panels into a plumb or vertical position. Panel placement for these systems require skilled experienced workers to erect the units so that the resultant structure will be vertical and not leaning either in or out of a vertical plane.

Full height panels have been used on MSE walls where the MSE layers are connected to the wall face. Temporary erection braces are required for these system to hold the panels in place as the backfill is placed behind the wall. This requires additional working right-of-way in front of the wall and restricts site access. Since the soil reinforcement material, whether geosynthetic or metal, is not designed for concentrated high loads at the connections of the soil reinforcement material it is critical that all panel connections should, in theory, have quantifiable uniform loads. This condition is extremely difficult, if not impossible, to achieve in the field. This is one of the primary reasons why few full height MSE panel walls have been built with precast face units. An indeterminacy situation exists for the load determination at the numerous connections of the soil reinforcement material to the panels for these types of walls since typically the number of soil reinforcement connections to the wall facing exceeds the number of equations available to solve for the individual connection loads.

There is a portion of retained soil loading on the wall face in full height and all MSE panel systems currently in use and any vertical settlement (relative motion) between the tensile inclusion soil reinforcement layers and the panel face can induce excessive shear loads on the soil reinforcement material at the connection point to the panel. Typically there is no adequate provision to allow for this vertical movement without inducing shear forces on the tensile inclusion material at the connection to the wall face for the systems currently in use. Many panel connection devices have been installed and utilized for these various systems currently in use wherein the wall face can, in theory, move with respect to the soil reinforcement material. Panel connections such vertical bolts supported by clevises cast into the panels connected to the metal strip soil reinforcement have been used to allow for vertical movement. The high horizontal earth loading on the individual connections results in large friction loads at the bolt and as a result the relative motion desired at the connection has not typically been achieved.

Vertical settlement of the whole MSE wall mass, wherein the panels move with the MSE structure is, for some sites a valid assumption, because the forces supporting the vertical wall and backfill loads are uniform. Unfortunately, for certain wall sites, the retaining structure may rest on material that does not have uniform bearing capacity over the reach of the wall. For these sites, if there is compressible material under some portions of the MSE mass, the structure will not settle uniformly. This can result in differential settlement between the wall elements and the wall mass which can lead to structural failures of varying degrees.

Another broad range of MSE wall types that have been used extensively for permanent and temporary retaining wall applications are wrapped face or confined fill layers that form the geotextile MSE wall. These walls are comprised of an assembly of vertically stacked layers of wall backfill confined by closed face sheets of geotextile that are typically placed in horizontal planes within the wall backfill as the backfill is placed and compacted. For temporary walls the the face of these walls is the exposed geotextile material. The geotextile that retains the fill at the face of each layer is wrapped back into the fill behind the face of the wall. The wrap back geotextile is imbedded into the backfill material behind the face of the wall for each compaction lift of fill that is placed. One of the difficulties associated with the construction of these types of earth retention structures is that the wrapped back face portion of each backfill layer requires that an external forming system be installed in front of the face of the wall to hold the geotextile face at the proper alignment until the wrap back portion of the geotextile layer is sufficiently imbedded in the backfill adjacent to the wall face. The associated fill pressure prevents the wrap back geotextile from being displaced horizontally. The cost of labor associated with the placement and operation of the external forming system adds to the cost of these types of walls.

Whether the geotextile wall is a temporary or permanent structure a face forming system is required so that the resultant overall wall face will conform to the wall alignment limits. For permanent geotextile walls it is necessary to cover the exposed wall face so that the geotextile will be protected from the deleterious effects of prolonged exposure to ultra violet radiation. Although the geotextile material is corrosion resistant with respect to the soils and minerals that the material may come into contact with due to the embedment in the wall backfill the long term effects of exposure to the sun can result in the ultimate deterioration of the wall face. Various facing materials that have been used to cover the face of geotextile walls include: sprayed concrete faces, precast or cast in place concrete panels. The use of a sprayed concrete face require that attachment fasteners such as lengths of wire or pieces of rebar be installed in the wall and protrude from the face of the wall to form a connection between the sprayed on concrete and the exposed geotextile surface. The disadvantage of walls with this type of face is that the wall surface is typically not uniform and not aesthetically pleasing. Additionally if the walls experience any significant long term settlement cracking and spalling of the sprayed concrete face can occur.

Precast facing elements have also been attached to wrapped face geotextile walls by the use of long bolts or thread bar anchors that are screwed into the geotextile earth retention structure. Although these methods are adequate to provide U.V. protection because of the metal anchors the life of the wall is reduced. Also the precast facing is rarely attached accurately so the resultant wall face may not be uniform in appearance.

Another wall face that has been used for geotextile walls is the option of casting a poured in place concrete face over the geotextile wall. This approach can result in a uniform aesthetic face but it does require extensive forming and the associated high field labor and material costs. These additional costs can make walls of this type less competitive than other conventional wall types.

In view of these and other shortcomings of prior art, there is a need for an improved MSE retaining wall system. Accordingly it is the object of the present invention to provide an improved MSE wall system with a full height panel facing of precast concrete or other suitable material that can be precast, pre-manufactured, or assembled and that, although attached to a separate structural MSE wall ,the face is isolated from the MSE wall.

It is another object of the present invention to provide an improved MSE wall retaining system wherein the reinforced soil mass can be constructed to essentially full height prior to attaching the wall facing units.

It is another object of the present invention to provide an improved MSE wall retaining system wherein the reinforced soil mass is comprised of layers of confined soil, sand, or other suitable backfill material for use in MSE walls.

It is a further object of the present invention to provide for an improved wall system that can utilize a mechanically stabilized backfill wall formed by vertically stacked confined fill layers of flexible tensile inclusion soil reinforcement material and wall backfill.

It is another object of the present invention to provide an improved MSE wall retaining system wherein tie rods and anchors are installed in the reinforced soil mass formed of confined fill layers as it is built.

It is a further object of the present invention to provide for an improved wall system that utilizes connecting tie rods that exhibit a low sliding coefficient of sliding friction between the confined fill layers of the separate MSE wall.

It is a further object of the present invention to provide for an improved wall system that can utilize full height wall panels that are connected to tie rods previously placed in the layered confined fill MSE wall.

It is a further object of the present invention to provide for an improved wall system that allow the use full tier height wall facing units where the top of the wall panel or facing unit corresponds to, at a minimum, the top of the separate MSE wall.

It is a further object of the present invention to provide for an improved wall system that allow the use full tier height wall facing units that if the top of the panel corresponds to the top of the overall wall height that the panel height is less than the overall height of the wall.

It is still a further object of the present invention to provide an improved wall system that prevents significant earth loading to be transmitted to the facing units.

It is yet another goal of the present invention to provide an improved wall system that can utilize tensile inclusion members of either geosynthetic, metal or other suitable flexible, high tensile strength material.

It is yet another object of the present invention to provide an improved wall system that allows the facing units to be placed on a wall panel foundation that is located at a higher elevation than the base of the confined fill layers of a separate MSE wall.

It is still a further object of the present invention to provide for an improved wall system that provides a work platform within the separate MSE structure at an elevation substantially above the base of the wall to facilitate the installation of the facing panels.

It is still a further object of the present invention to provide for an improved wall system that allows the placement and attachment of the full height facing units to the separate MSE wall from the work platform on the wall without the use of temporary erection braces.

It is still a further object of the present invention to provide for an improved wall system that allows the facing units and or the facing unit support components to function as a face form support for the confined fill layers of the separate MSE wall.

It is still a further object of the present invention to provide for an improved wall system that does not preclude the confined fill soil layers of the separate MSE wall to be installed parallel to the grade at the top of the wall.

It is still a further object of the present invention to provide for an improved wall system that has a minimum number of connections to each wall panels from the MSE soil mass.

It is still a further object of the present invention to provide for an improved wall system that provides a continuous void space between the facing units and the face of the confined fill layers of the separate MSE wall.

It is still a further object of the present invention to provide for an improved wall system that utilizes continuous spanning closure components at the upper portion of the separate MSE wall to span the horizontal void between the back of the facing units and the face of the confined fill layers.

It is still a further object of the present invention to provide for an improved wall system that allows the optional use of compressible chimney fill to partially fill the void space between the back of the facing units and the front of the layers for the confined fill MSE as a compressible layer to compensate for horizontal strain within the MSE mass and not transfer these stresses to the facing units.

It is still a further object of the present invention to provide for an improved wall system to have sufficient tolerances at the component connections to allow for significant vertical and horizontal displacement at the component interface to facilitate ease of assembly of the components.

It is still a further object of the present invention to provide for an improved wall system that reduces or effectively eliminates the possibility of inducing vertical shear stress on the facing unit connectors to the separate M.S.E. earth retention structure.

It is still a further object of the present invention to provide for an improved wall system that is not dependent on the type of MSE soil reinforcement used for the soil tensile inclusion members for the separate MSE wall.

SUMMARY OF THE INVENTION

In accordance with the present invention, a full height precast panel MSE wall system is provided. The retaining wall system generally stated, includes: an assembly of full height wall panels with an elevated base; a plurality of tie rod/plate assemblies imbedded in a separate MSE wall structure for attachment to and to position the wall facing panels in a stable vertically disposed plane, and a continuous closure beam between the separate MSE wall and the panel facing. The wall system provides a combination of permanent full height, non bearing, facing panels founded on an elevated base and attached to a separate dosed face MSE wall that allows for economical corrosion protection and for vertical differential settlement between the separate MSE wall and the facing elements.

The tensile inclusion members for the MSE soil reinforcement material used for the separate MSE wall for the present invention can be geotextile, geogrid, metal grids, (for temporary structures) or any other suitable high strength flexible material that can be placed in overlapping dosed face layers that are generally horizontally disposed to confine the wall backfill in individual layers. The preferred synthetic soil reinforcement is high strength geotextile sheets which can be used to form the confined fill layers with wrapped back faces to form the MSE wall earth retention structure. The geotextile tensile inclusion sheets are used to form confined fill layers with a wrap back face that are placed in sequential parallel layers proceeding from the base of the wall. The layers are typically parallel to the grade at the top of the wall. If materials other than geosynthetics are used for the MSE reinforcement, the face of the layers at the wall face are either wrapped back and covered with a strip of geosynthetic material to prevent wall backfill from migrating from the confined fill layer or by using other suitable light weight, flexible economical facing between the tensile inclusion members. The layers of the tensile inclusion material used to reinforce the retained soil typically have an embedment depth of one halve to seven tenths of the wall height. The vertical spacing of the layers varies depends on the wall height and section of the wall. The lower layers are typically spaced on six to twelve inch increments and the upper layers would be placed in the range of twelve inches to one foot six inch increments. The spacing and embedment depth are site dependent and vary depending on the specific site design for an individual wall. Since the vertical spacing of the tensile inclusion material is not required to conform to the vertical dimensions of the individual facing units, as would be required for wall systems using Concrete Masonry Units (C.M.U.) blocks for wall facing, the optimum use or minimum amount of tensile inclusion material for wall stability is possible with the present invention. The number of layers of soil reinforcement for the present invention can be optimized since the spacing is dependent on the strength requirements of the material rather than dependent on facing unit dimensions. The ability of the present invention to utilize the optimum amount of soil reinforcement material is a cost savings advantage compared to other wall systems in current use.

Placed between confined fill layers of the MSE walls at the base of the wall are tie rod/plate assemblies that are required to secure and hold the foundation blocks from horizontal movement. These cast in place or precast concrete elevated foundation blocks are located at the panel vertical abutting joints and ultimately support the weight of the full height panels and restrain the panels from horizontal movement. The pedestal is formed with a notch or front flange at the top of each elevated foundation block corresponding to the bottom edge and face of the full height panels. The elevation of the bottom of the notch corresponds to the plan bottom of panel elevation. The difference in elevation of the bottom of the panel (or the top of the notch) and the base elevation of the first confined fill layer of the separate MSE wall corresponds to the height that the full height wall panel is elevated above the bottom of the MSE wall.

The wall panels are supported by the elevated foundation blocks. A lower tie rod/plate assembly attached to each foundation pedestal prevents the pedestals form being displaced horizontally. The front flange of the elevated foundation pedestal, in turn, constrains the panels from any horizontal displacement. A foundation block is required at each vertically disposed panel edge. Since no significant soil loads can be transferred to the wall panel any loads placed on the panel are transient and can result from a seismic or similar loading condition that may be induced on the panels during a seismic event or wind loads that could be placed on the panel during the erection of the panel.

If the notched elevated foundation blocks are precast then a sleeve is cast into the pedestals that corresponds to the location of the tie rod. For the precast option a front plate and nut is required on the front threaded end of the tie rod after the precast pedestal has been placed at the correct field location. For either the precast or cast in place option, following the placement or casting of the pedestals, the confined fill layers of the separate MSE structure are placed up to the elevation of the work platform before attaching the full height wall panels. For wall sites where low soil bearing pressures and or future consolidation of the wall foundation is expected the completion of the major portion of the separate, confined layered fill MSE wall prior to the attachment of the facing panels is a distinct advantage of the present invention. Other MSE wall systems currently available require that the wall backfill be placed consecutively with the soil reinforcement and the facing units. One of the advantages of completing the separate, confined, layered fill MSE wall up the the work platform elevation at typically two thirds to three quarters of the wall height is that the reinforced soil mass of the separate MSE portion of the present invention effectively surcharges the wall footprint area. This surcharge initiates and significantly completes consolidation of the wall foundation prior to placement of the full height facing panels. By minimizing the potential for future relative vertical settlement of the wall system due to the surcharge effect of the MSE wall the probability of visible deviations or distress at the wall facing is reduced.

The full height facing panels are relatively large in size (e.g. 80 to 250 sq.ft. in facial area) and are generally rectangular in shape and in cross section. The panels are placed on elevated foundation blocks with the generally disposed vertical panel edges abutting each other forming a closed face over the separate MSE wall. Each wall panel generally has a flat exposed face although various architectural features can be added to the face. Each panel typically has two or more attachment inserts included and are installed into the backside of the panel for the attachment of the tie rod during the manufacture of the panels.

The panels are attached to the separate, layered, confined fill MSE wall at the the work platform elevation of the MSE wall. This elevation is typically ⅔ to ¾ of the total wall height or as shown on the plans. The upper tie rod/plate assemblies will have previously been installed between confined fill layers of the wall at the work platform elevation prior to panel installation and attachment. The tie rods are positioned perpendicular to the wall face and are displaced from adjacent tie rods at a horizontal distance equal to the panel width. Each panel typically requires at least one tie rod at the joint or vertical edge of each adjacent wall full height panel. The confined fill layers above the work platform elevation and over the upper tie rods are offset from the face of the lower layers of confined fill layers previously placed. A sufficient amount of confined wall backfill is placed over the tie rod assemblies to immobilize the tie rods prior to attaching the tie rods to the panels. The horizontal displacement of the offset layers provides a staging area, or "work platform", from which the the attachment of the tie rods to the panels can be accomplished form the inside or at the backside of the wall panel. An adjustable attachment channel or equivalent attachment device is attached to the front threaded end of the tie rod prior to panel installation. The panel, after being bolted to the channel, is secure from any horizontal displacement.

The optional use of over sized sliding sleeves installed over the tie rod assemblies as described in U.S. Pat. No. 5,468,098 issued to John Babcock to attach the panels to the separate MSE wall provide a mechanism that allows for vertical movement of the MSE wall mass relative to the panel facing and tie rod without inducing any shear loads on the tie rods. Although most of the settlement should occur in the separate MSE wall prior to placing the wall panels, the oversized sleeves, if used, will compensate for additional vertical displacement due to either consolidation at the foundation or slight settlements within the MSE stabilized mass. Slight vertical displacements (downward motion) of the separate MSE wall mass could result from either consolidation or strain within an individual confined fill layer cell of the MSE wall.

It has previously been stated the panel shape will be generally rectangular unless there is a requirement for the edges of the panels to be vertical. In that case the shape of the panels would generally be that of a parallelogram with the sides of the panel being vertical and the top and bottom edges being parallel to the grade at the top of the wall. Having a panel shape that follows the grade allows for numerous advantages that cannot be achieved by other systems that offer a single panel shape. By having the top of the panel follow the grade at the top of the wall, coping that is usually required for other systems to conceal the gap between the top of a fixed panel shape and the grade required at the top of the wall, is eliminated with the use of the facing units for the present invention. Also since the top and bottom edges of the panels are parallel to the confined fill layers of the separate MSE wall the distance from the top edge of the panel to the top attachment inserts cast into the panels is consistent rather than being different for each panel which would be the case if the panels were not manufactured to correspond to the profile of the wall geometry. By providing a redundant critical dimension at the panel insert location the probability of manufacturing errors is reduced and therefore the risks of field fit problems at the insert panel connector are minimized.

The other typical panel shape for facing units for the present invention is rectangular. This shape panel is the most cost effective panel shape and it is used where there is not a requirement for the edges of the panel to be vertical. For walls that use the rectangular shape panel the top of the panel and the bottom of the panel will typically be oriented parallel to the grade at the top of the wall and the opposing edges of the panels will be oriented at a normal angle to the grade at the top of the wall. Although these edges can be at a vertical orientation , since there is typically a grade at the top of earth retention structures the opposing panel edges for panels with a rectangular shape will be perpendicular to the top of wall grade. By orienting the panels parallel to the top of wall grade the top and bottom edges of the panels are also oriented parallel to the confined fill layers. All of the dimensions to the tie rod locations are typically consistent and correspond to the insert locations, which result in redundant manufacturing dimensions and an efficient production of the panels. Although the preceding panel shape is described as either generally rectangular or as a parallelogram other shape facing units can be used with these and other embodiments of the present invention equally without the restriction to be either rectangular or of a generally parallelogram shape.

The remaining portion of MSE wall over the work platform is built following the panel erection and attachment to the upper tie rod/plate assembly. This portion of the MSE structure is typically the only portion of the separate MSE wall that is not completed prior to installing the panels. The back face of the panels that extend above the work platform elevation can be utilized for a face forming support for the remaining confined fill layers of the separate MSE wall.

Compressible fill is an optional fill that can be placed in the continuous void between the back of the wall panels and the face of the layers of confined fill that form the separate MSE wall structure. Performance of this "chimney fill" requires that the fill placed in the void be an Expanded Polystyrene or a comparable compressible granular mixture. The compressible requirement is necessary to compensate for any strain or creep that may occur in any of the confined fill layers of the separate MSE wall following the attachment of the full height panels to the separate MSE wall. For wall installations where water may be expected to collect in the void between the back of the facing units and the face of the MSE wall the use of the compressible chimney fill will compensate for the expansion loads that could be placed on the panels if any water within the void became frozen. By using the compressible "chimney fill" any stresses and the accompanying strain of the confined layers (horizontal displacement) or ice expansion loads can be absorbed by the compressible fill without placing any additional horizontal loading in the wall panel.

The vertical void space between the back of the full height and the face of the separate MSE wall is closed at the top portion of the wall by the use of a continuous light weight blocks of material such as Expanded Polystyrene. The blocks are placed end to end to form a continuous closure beam. The vertical dimension of the closure beam corresponds to the height of the top confined fill layer, which is placed behind the closure beam, and the width of the block is greater than the horizontal width of the void between the back of the panel and the face of the MSE wall. The blocks are placed end to end over the void resting on top of the uppermost confined fill layer and in contact with the back face of the facing panel. The loads imposed on the facing units of the present invention, due to the separation void, are comparable to wind loading the facing units can be sound wall panels or other light weight inexpensive panels that would otherwise not have sufficient structural capacity to be used for facing units for MSE wall applications in current use. The use of light weight, low cost, panels, with a reduced square footage compared to other currently available wall systems is a distinct cost savings attribute of the present invention.

The face of the top confined fill layer behind the closure beam is displaced horizontally from the back of the closure beam so that the face of the top confined fill layer does not come into contact with the back of the light weight blocks at any location. An extension layer of geotextile or other suitable material is placed over the top of the blocks and the top confined fill layer following completion of the top confined fill layer. The use of the this extension layer or flexible membrane prevents any portion of the of unconfined wall backfill above the top confined fill layer from entering the void space between the back face of the closure beams and the face of the top confined fill layer behind the blocks. This extension layer of flexible material also extends up the back of the panel. The closure beam and the flexible membrane at the top of the wall seals the void space between the wall facing and the layer of unconfined fill at the top of the wall. Since the height of the final unconfined fill layer corresponds to a typical compaction lift height the contributing portion of earth loading that is transmitted to the wall panel from the unconfined fill layer at the top of the wall is minor. This negligible load at the top of the wall panel is not significant when compared to retained earth loading the the wall facing units of other currently available MSE wall systems are required to structurally withstand.

In an alternate embodiment of the present invention the full height facing panels are supported on a remote, elevated, foundation beam. The foundation beam is placed on top of the last base extension confined fill layer of the separate MSE wall. The confined fill layers extend sufficiently in front of the wall to provide adequate panel bearing and clearance between the separate MSE wall and the panels. The foundation beam is typically not attached or anchored to the separate MSE wall. By providing the optional panel support foundation beam placed on extension confined fill layers at the base of the wall the dead weight of the panel is distributed over a wide are which, for high walls or for walls located on weak foundation materials, effectively reduces the required bearing pressure of the wall foundation. The ability of this embodiment of the present invention to redistribute and increase the allowable foundation pressure by the use of a foundation beam supported on confined fill extension layers at the base of the wall is a key design feature of the present invention.

The lower tie rods, for this embodiment of the present invention, extend out in front of the face of the panel face at the vertical panel edge through a clearance notch in the panel edge. By providing a tie rod/plate assembly at each panel edge the panels are prevented from any horizontal displacement following the attachment of a front plate and nut to the front threaded end of the lower fie rod. The remainder of the component assembly for this alternate embodiment is identical to what has been described for the preferred embodiment.

In another alternate embodiment of the present invention a wall system includes vertical, flanged, support columns to hold generally horizontally disposed rectangular wall panels placed between adjacent vertical columns. The columns are secured to isolated foundation pods and to upper and lower tie rod plate assemblies embedded within the separate confined, layered fill MSE wall. Varying width panels are stacked edge to edge behind column flanges and between adjacent columns to form a full height wall face. The bottom edge of the bottom panel is displaced vertically with respect to the base elevation of the separate MSE wall with the use of appropriately sized spacer blocks. The long sides of the panels typically are parallel to the grade at the top of the wall as are the confined fill layers of the separate MSE wall. After the panels are placed the remaining installation of the components of the embodiment proceed similarly to what has been previously described for the preferred embodiment of the present invention.

In yet another embodiment of the present invention an optional horizontally adjustable panel connector is provided. The use of this optional component allows the adjustment for horizontal alignment of the panel to be made from the outside of the wall following completion of the wall. The adjustable connector can be used to displace the panel horizontally by inserting a keyed shaft between the panel joints and rotating the grooved threaded connector attached to the panel channel connector. The use of the alternate embodiment eliminates the requirement to remove a significant portion of the separate MSE wall should panel adjustment be required for aesthetic reasons as a result of unusual loading conditions, such as a seismic event that could result in a deflection of the wall assembly.

These and other components, features and advantages of the present invention will be apparent following the more complete description of the preferred embodiment of the invention as shown in the accompanying drawings and schematic illustrations.

DETAILED DESCRIPTION OF THE PREFERRED EMBODIMENTS

Figure 1:
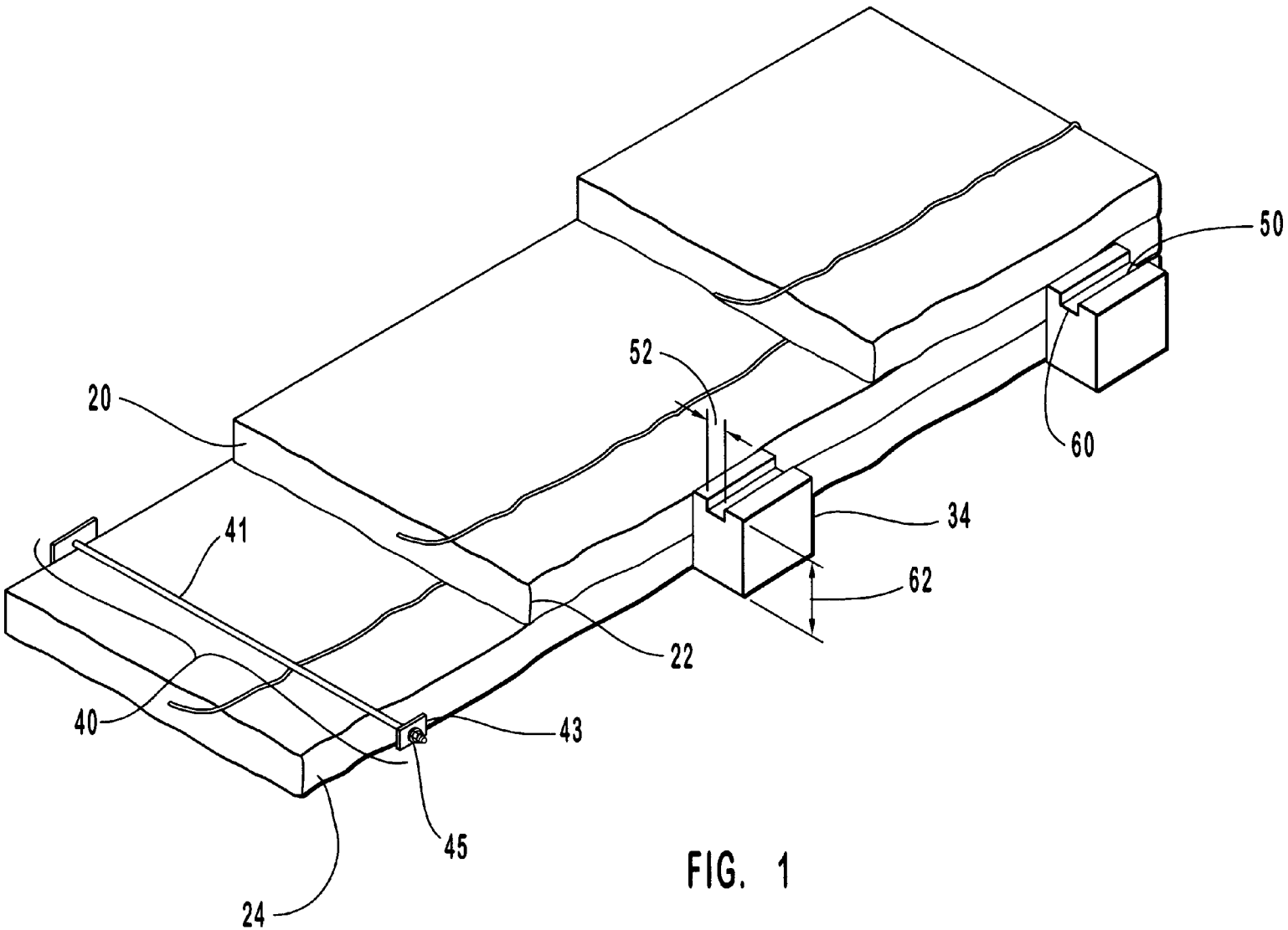
FIG. 1 is an isometric view of the initial wall construction sequence for a full height panel wall system built in accordance with the invention.
Figure 2:
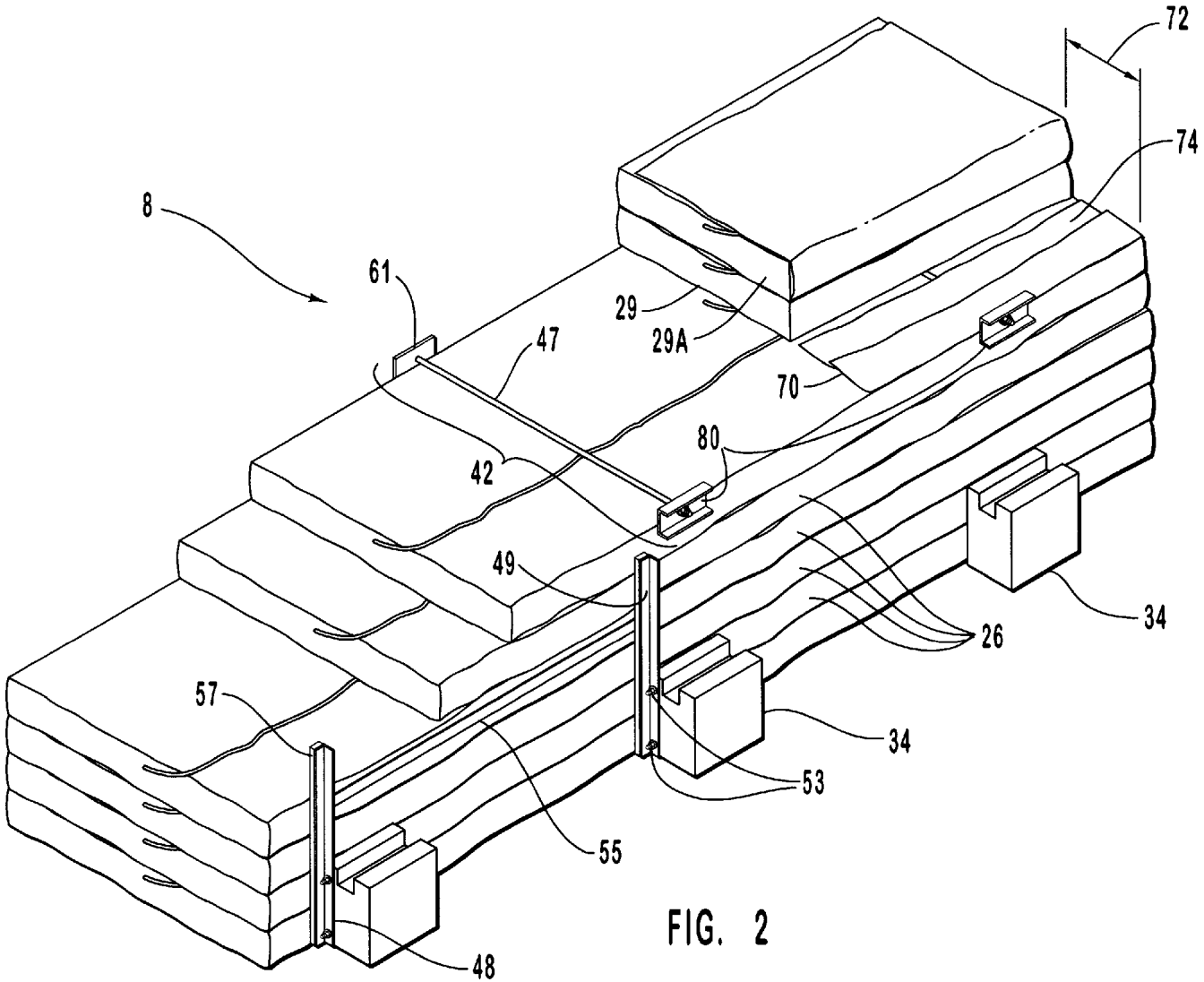
FIG. 2 is an isometric view of a wall system under construction with the left side of the drawing showing temporary face forming struts for the separate MSE wall and the right side of the drawing showing tie rods installed within the separate MSE wall.
Figure 3:
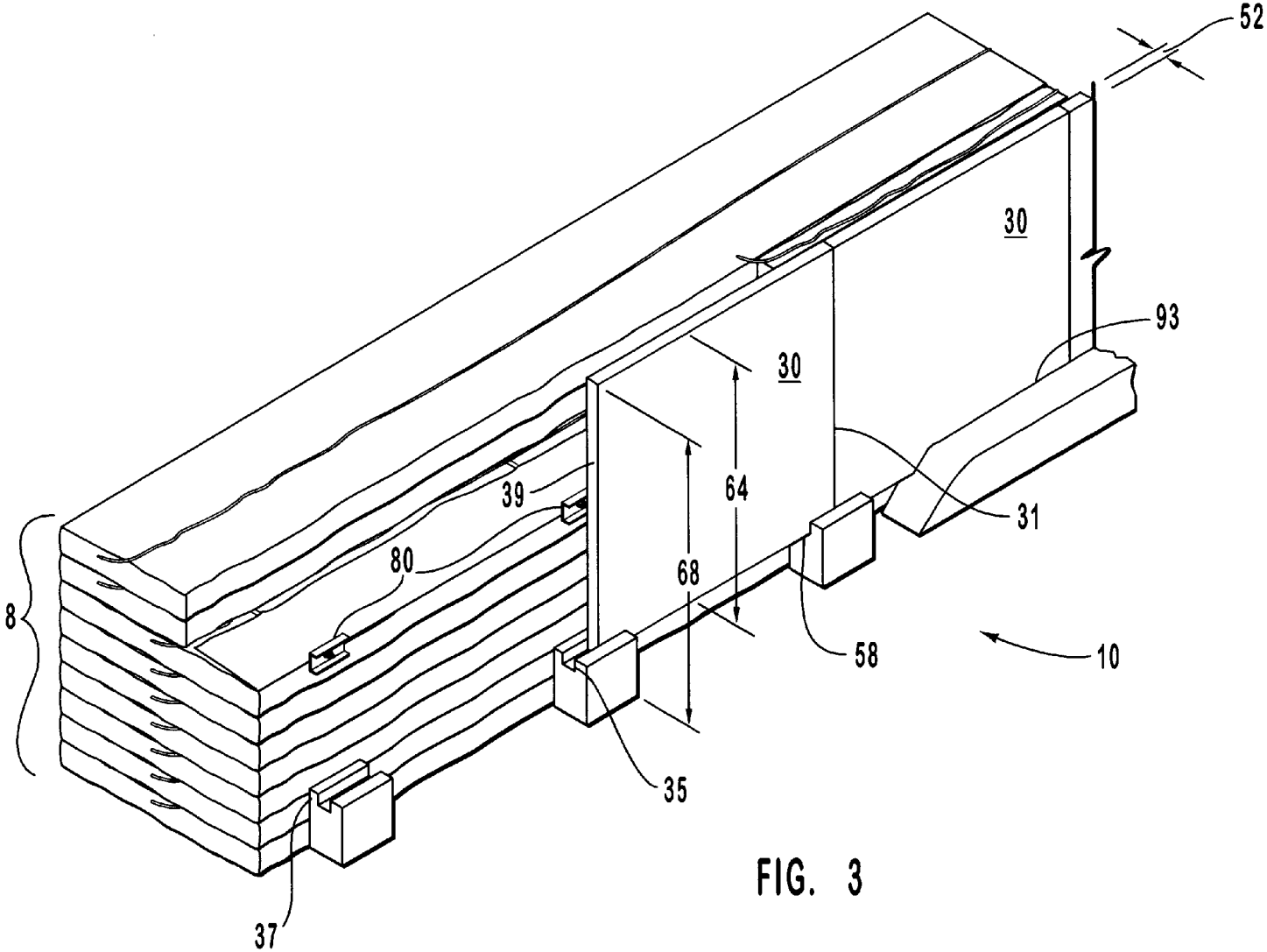
FIG. 3 is an isometric view of full height panels set on elevated foundation blocks and attached to panel connecting channels.

Referring to FIG. 1–4 a full height panel M.S.E. wall is shown under construction and is generally designated as 10. FIG. 3 is cut away to illustrate the manner in which the full height panels of the system 10 are installed and attached to the separate Mechanically Stabilized Earth (M.S.E.) wall 8. In general the retaining wall system 10 comprises an assembly of full height precast wall panels 30 which extend to or beyond the top of the M.S.E. wall 8 and are held in a vertical position by the stabilizing effects of the elevated notched foundation blocks 34 and the upper tie bar assemblies 42.

Figure 4:
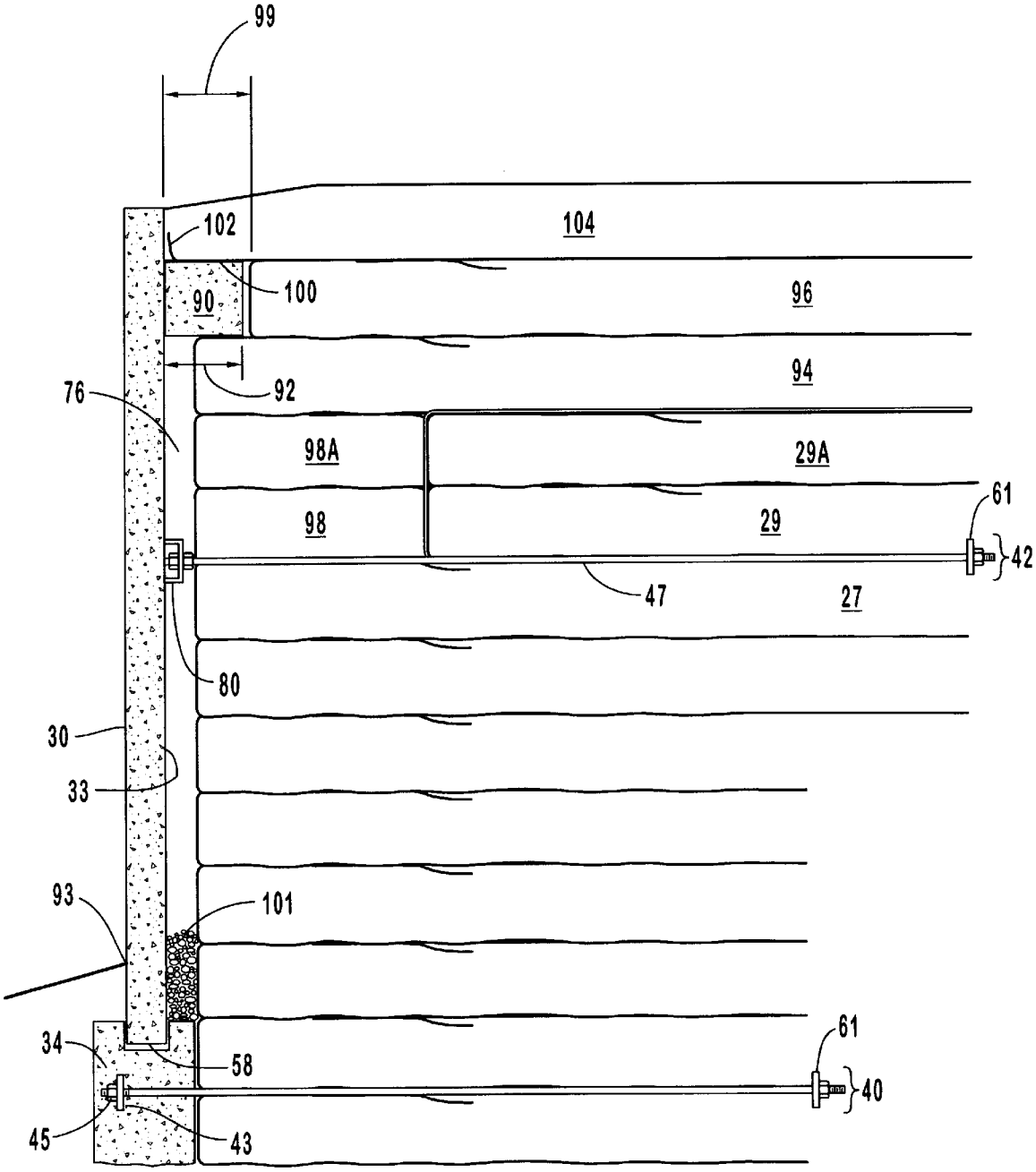
FIG. 4 is a section through a completed full height panel wall assembly.

The full height panel 30 has a generally rectangular peripheral configuration and is formed of a material suitable for precasting or pre-manufacturing such as concrete. Each wall panel typically has at least one attachment insert 46 cast into the back face 33 of the panel 30 as shown in FIG. 4.

The elevated notched foundation block 34 is shown as it has been cast in the field. FIG. 1 depicts a typical construction sequence associated with the field casting of the block 34. A notch 50 with width 52 slightly wider than the width of the panel 54 is cast in the elevated notched foundation block 34. The panel bottom edge 58, when placed in the notch 50, is restrained from horizontal displacements. The bottom of the notch 60 is elevated a vertical displacement 62, from the bottom elevation of the separate M.S.E. wall 8 corresponding to the elevation of the bottom edge 58 of the wall panel 30. This vertical panel displacement 62 of the panel 30 results in a wall panel height 64 that is reduced compared to the overall wall height 68. The economic benefit of the elevated foundation is a reduced panel square footage required to build a wall in conformance with the present invention compared to the e panel square footage needed for other precast retaining wall systems. Other systems in current use require that the bottom of the facing units correspond to the base elevation of the wall. The elevated panel bottom edge 58, with respect to the bottom of the separate M.S.E. wall 8 ,is a unique and cost effective feature of the present invention compared to other systems in current use.

The wall system 10 is a combination of a separate M.S.E. wall 8, upper and lower tie rod assemblies 40, elevated notched foundation blocks 34, and full height wall panels 30. A portion of the M.S.E. wall 8 is shown under construction in FIG. 1. The separate M.S.E. mass 8 is formed by endosing retaining wall backfill material 20, such as soil, in closed overlapping tensile inclusion material layers 22. Although many high strength, flexible materials are available and can be used for the tensile inclusion material for the separate MSE wall 8 the preferred material is high strength geotextile. The base confined fill layer 24 is shown in FIG. 1. After installing the base confined fill layer 24, the lower tie rod assemblies 40 are placed as shown in FIG. 1 at a horizontal location on the confined fill layer 24 that will correspond to the vertical edge 31 of the full height panel 30. Following placement of the lower tie rod assemblies 40, the elevated notched foundation blocks 34, if poured in place, are cast in place over the front plate 43 and front securing nut 45 of the lower tie rod assembly 40. The elevated notched foundation blocks 34 can also be precast or premanufactured and if so they are placed and secured with the front nut 45 in the field over the base tie rods 40.

Following the casting or setting of the elevated notched foundation blocks 34, the mid wall confined fill layers 26 are installed as shown in perspective in FIG. 2. A temporary vertical face forming strut 50 can be attached by bolts 53 to the elevated notched foundation block 34 prior to installing the mid wall confined fill layers 26. The temporary vertical face forming strut 48 can be used to hold horizontal moveable braces 55. The horizontal moveable braces 55 can be structural dimension lumber or some other rigid material that will structurally span and support the face of a layer of confined fill between the temporary vertical face form struts 54. A compressible cushion strip 57 is shown placed against the front flange 49 of the temporary vertical face form strut 48 which will absorb temporary equipment loading forces against the horizontal moveable brace 55 as the mid wall confined fill layers 26 are constructed. The multifunction capacity of the elevated foundation block 34 to be used as both a panel support and to be used as a temporary face form support is a key design feature of the present invention. The use of the elevated foundation block 34 to assist in the face forming of the separate confined fill layers 26 etc. of the MSE wall 8 eliminates the need for an additional face forming support system which has heretofore been required to construct wrapped face geotextile walls. Additional construction cost savings for walls built in conformance with the present invention are achieved by the utilization of the multifunction capacity of the elevated notched foundation block 34.

When the top layer 27 of the mid wall confined fill layers 26 has been installed, the upper tie rod assemblies 42 are shown placed on top of confined fill layer 27 at locations corresponding to the vertical plan location of the vertical joint 31 of the full height panels 30. The rear plate 60 and front panel attachment channel 80 are shown forming to the upper tie rod assembly 42.

Following placement of the upper tie rod assembly 42, the secondary face wrap geotextile layer 70 of the work platform offset 72 section of the separate M.S.E. mass 8 are shown folded over the tie rod assembly 42 and pulled back over the confined fill layers 29 and 29A. The work platform offset confined backfill layer 29 is now placed over and behind the secondary face wrap geotextile 70. In order to insure adequate fill pressure over the tie rod assembly 42 another second confined fill soil layer 29A is typically required. The second layer of geotextile 74 is shown folded back over the top of the work platform offset confined fill layers 29 & 29A. The upper tie rod assemblies 42 are now held immobile by the weight of the confined fill layers 29 & 29A of the work platform offset 72. Although two confined fill layers 29 and 29A are shown over a upper tie rod assembly 42 the amount of confined fill over the tie rods 42 is site dependent and proper utilization of the present invention is not dependent on the number of confined fill layers that are placed over the upper tie rod assemblies 42.

The next stage of wall construction is the placement of the full height panels 30. A panel 30 is shown in place in FIG. 3. The panel 30 on the left has a vertical edge 39 exposed with half of the attachment channel 80 shown. Additional channel 80 details are shown in FIG. 3A.

The panel 30 is restrained from movement by the notch front flange 35 and rear flange 37 at the bottom edge 58 of the panel 30. An alternate method (not shown) that is an equally acceptable method to form the rear flange for the elevated foundation pedestal 34 is that of attaching a rigid angle (not shown) to the top rear portion of footing 34 that includes as a minimum a front flange to support the panel 30 prior to attaching the rigid angle(not shown). Additional restraint from horizontal movement of a panel 30 is achieved by the attachment of the upper tie rod/plate assembly 42. The attachment bolts 51 that penetrate the channel mounting holes 82 are shown in FIG. 4. The immobile upper tie rod/plate assembly 42 covered by confined fill layers 29 and 29A, eliminates the need for temporary panel erection braces which would otherwise be required for the placement of large precast panels if used for wall facing for other wall systems in current use.

Figure 3A:
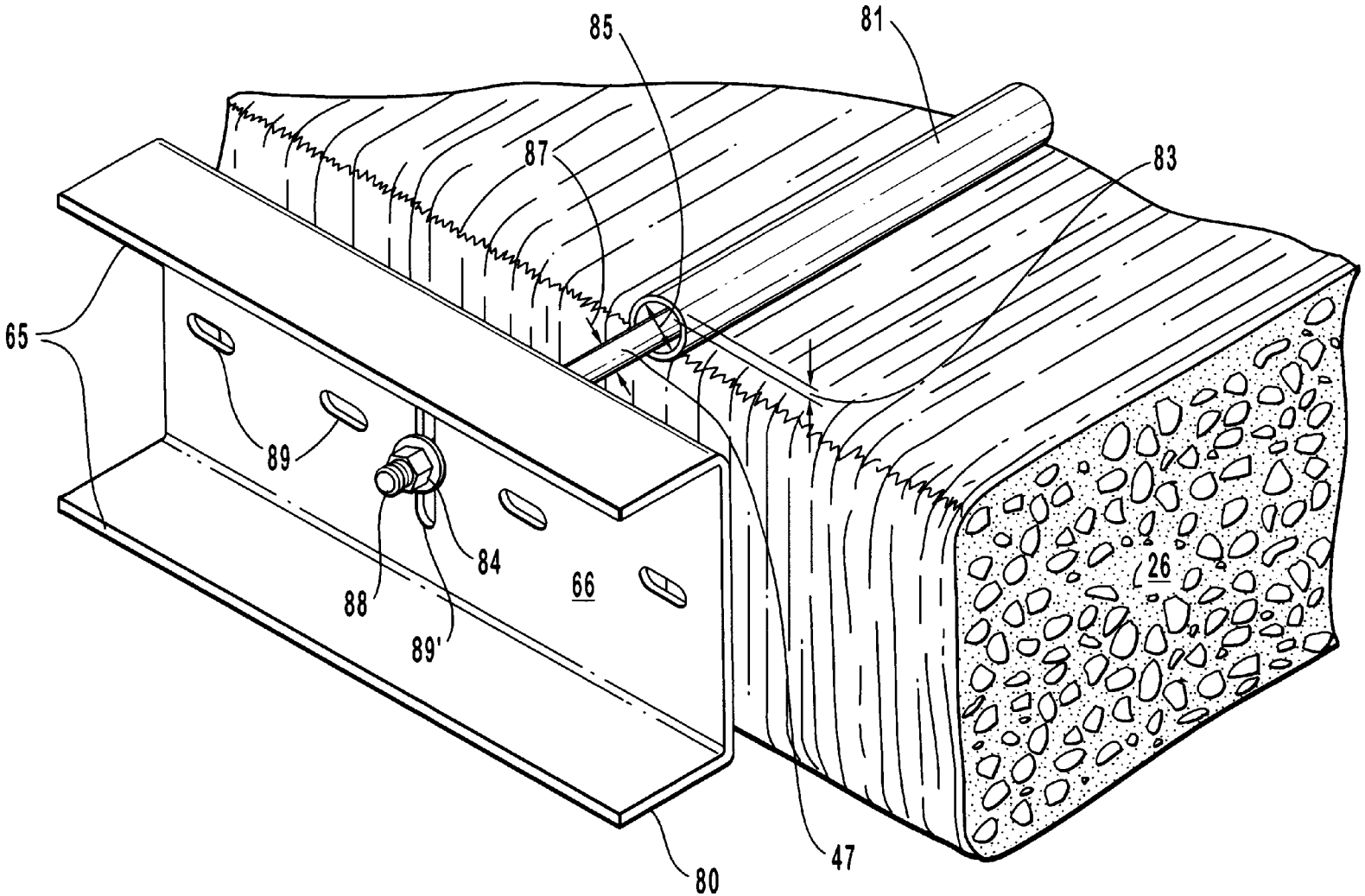
FIG. 3A is an isometric view of a panel channel connector attached to a tie rod placed on a confined fill layer with an oversized sleeve on the tie rod.

Referring now to FIGS. 2, 3, 3A, 3B, & 4 shows the panel attachment channel 80 in more detail. Additional typical features of the attachment channel 80 are shown in FIG. 3A. The attachment channel 80 is shown in the perspective drawing FIG. 3A attached to the upper tie rod 47. The tie rod 47 is shown in FIG. 3A inserted into an oversized sleeve 81 of polyethylene or of some other equivalent durable non-corrosive material. The optional use of the oversized sleeve 81 provides a mechanism to accommodate any potential, vertical settlement of the separate MSE wall 8 following the construction of the full height panel wall system 10. The use of the oversized sleeve 81 prevents the transfer of vertical shear forces associated with the settlement of the separate MSE wall 8 to the tie rod 47. The function of the oversized sleeve is further described in U.S. Pat. No. 5,468,098 issued to John Babcock on Nov. 21, 1995. The use of the oversized sleeve 81 can be used with all embodiments of the present invention.

The oversized sleeve 81 is shown placed on top of the confined fill layer 26 in FIG. 3A. The bottom of the tie rod 47 is shown in contact with the bottom of the inside of the sleeve 81. The difference in diameters of the inside diameter 85 of the oversized sleeve 81 and the outer diameter 87 of the tie rod 47 is the allowable vertical movement 83 that can be compensated for with the optional use of the oversized sleeve 81. The use of the oversized sleeve 81 would typically be for wall locations where additional wall settlement is expected following completion of the wall system 10.

The horizontal slots 89 shown in FIG. 3A on the channel web 66 allow for horizontal adjustment of panel attachment bolts 51. The vertical slot 89' in channel web 66 allows for vertical adjustment of attachment channel 80 in the field so that the location of the tie rod 47 and the plan vertical elevation of the channel 80 will match. The front nut 84 and rear nut 86 shown on the front threaded end 88 of the tie rod assembly 42 provide two functions that are important to the proper attachment of the full height panels 30. The nuts, 84 and 86, allow horizontal displacement adjustment of the attachment channel 80 so that the outside edge 64 of the attachment channel 80 will correspond to the back face 33 of the full height panel 30. By either advancing or retracting the nuts on the front threaded end 88 of the upper tie bar 47, the channel 80 can be positioned at the correct alignment parallel to and at the correct horizontal displacement from the back face 33 of the full height panel 30. After the attachment channel 80 is at the correct location on the threaded front end 88 of the tie rod 47, the front 84 and rear nut 86 are tightened against the web 66 of the channel 80 so that the channel 80 is immobile. Horizontal alignment of the attachment channel 80 is typically completed prior to the placement of the full height panels 30. Although the attachment channel is a preferable connection device other suitable attachment devices can be utilized to connect the panels 30 to the upper tie rods 47 without conflicting with the proper operation of the present invention.

Figure 3B:
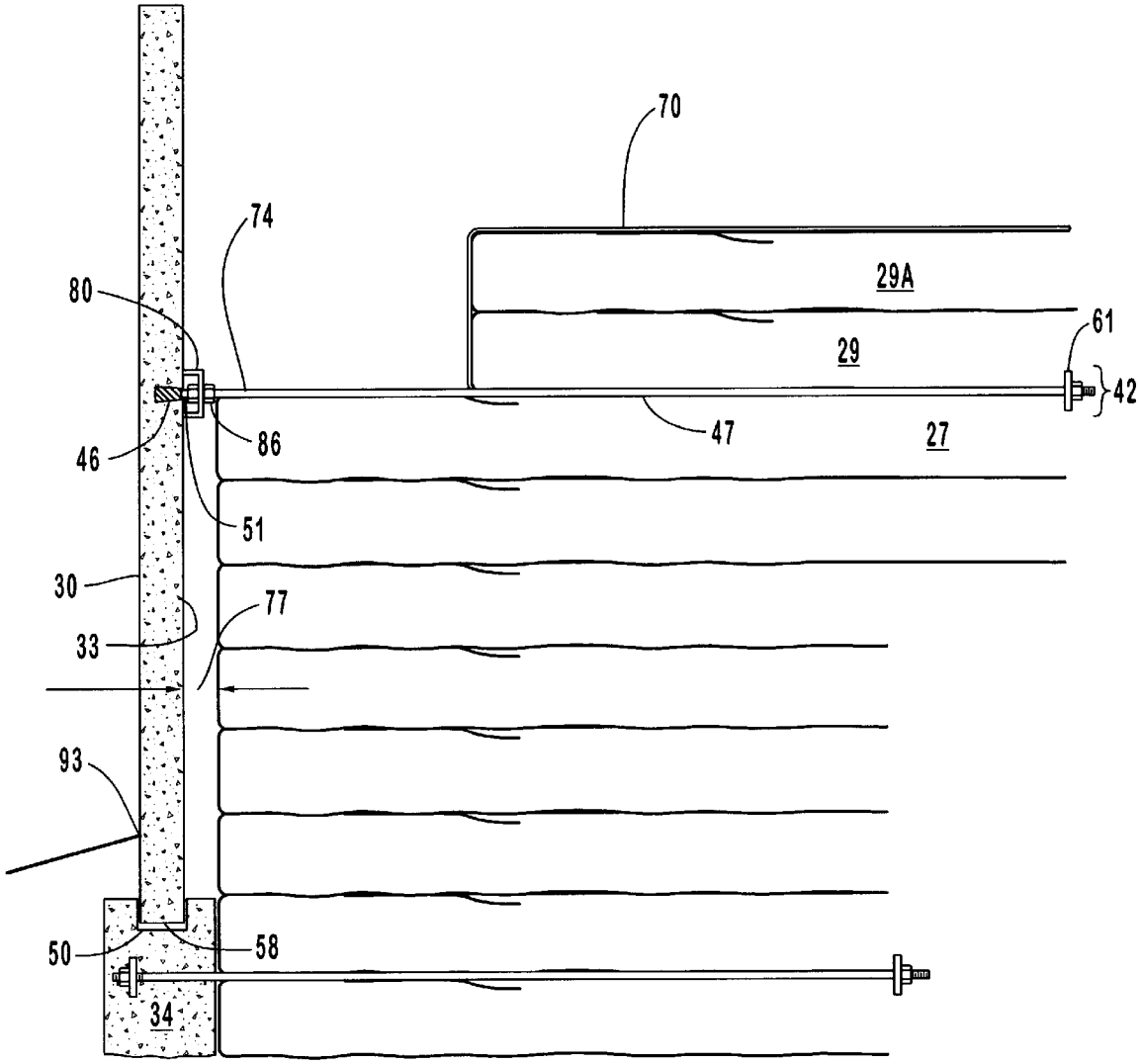
FIG. 3B is a section through an installed full height panel attached to the separate MSE wall at the completion of the work platform.

Referring now to FIGS. 3 and 3B show a full height panel 30 being erected and placed in front of and displaced horizontally a distance 77 from the face of the separate M.S.E. wall 8. The bottom edge 58 of the panel is shown set into the notch void 50 of the elevated notched foundation block 34. While the panel 30 is held in by the lifting lines (not shown), workers on the work platform 73 can insert panel attachment bolts 51 through slots 82 in a panel attachment channel 80 and thread bolts 51 into inserts 46 in the back face 33 of full height panel 30. After panel attachment bolts 51 are tightened to the required torque, the lifting lines (not shown) can be removed. The panel 30 is now held in a vertical position at a horizontal displacement 77 away from the face of the separate M.S.E. wall 8. Tie rods 47, when attached to the panel 30, function as both a temporary and permanent anchor for the full height panel 30. Erection braces, which would typically be required for panel stability when large facing panels are used as facing for other M.S.E wall systems are not required to be used to be in conformance with the operation of the present invention. The use of full height panels for other M.S.E. systems in current use are set prior to the construction of the integral M.S.E. structure for these systems. The multi-function of the upper tie rod assembly 42 to be utilized as both a permanent and temporary panel attachment securing mechanism, is a labor and time savings advantage inherent in the present invention which has heretofore not been available with the M.S.E. wall systems currently in use.

Following the placement of a number of full height panels 30, secondary confined fill layers 29 & 29A behind the work platform 74 can be completed. These layers 29 & 29A & 98 & 98A are shown on the wall section FIG. 4 completed with all the cover over the upper tie rod assembly 42 with the exception of the panel attachment channel 80.

The upper confined fill layers 94 & 96 are also shown in the wall section shown in FIG. 4. The top confined fill layer 96 is shown displaced horizontally away from the rear face 33 of the panel 30. This horizontal displacement distance 99 is slightly greater than the width 92 of the closure beam 90 shown placed against the back face 33 of the full height wall panel 30. For certain wall locations due to groundwater or if the face of the wall is exposed to any surface water flow the optional use of pieces of expanded polystyrene or other light weight low density material for loose fill 101 can be installed in the void space 76 below the slope intercept 93. The use of loose fill 101 provides a expandable medium (other than air) within the void space 76 at the base of the wall so that if water accumulates in the void the effects of expanding ice will not structurally impact the wall face.

Following installation of the top confined fill layer 96, the closure beam 90 can be installed. An optimum material for the closure beam 90 is a material comparable to Expanded Poly Styrene (E.P.S). The width 92 of the closure block 90 is sized to be sufficient to span the void 76 between the back face of the panel 33 and the front face of the separate M.S.E. wall 8. The width 92 of the closure block 90 will also be sufficient so that the closure block 90 will stay in the position shown in FIG. 4 without the possibility of sliding into the void 76 between the back face 33 of the panel 30 and the face M.S.E. wall 8. The distance 99, from the back face 33 of the panel 30 to the face of the last confined fill layer 96, is sufficient to prevent the face of the last confined fill layer 96 from coming into contact with the block 90. A membrane layer 102 of a suitable flexible material is shown in the wall section shown in FIG. 4 placed over the top of the block 90, over the top of the last confined fill layer 96, and extending up the back 33 of the facing panel 30. The use of this continuous strip of membrane 102 to cover the top of the closure block 90 and the displacement distance 99 from the face of the top confined fill layer to the back face 33 of the wall panel 30 and the face of the last confined fill layer 96 prevents the migration of any unconfined wall fill 104. The use of a closure block 90 at the top of the wall and the flexible membrane 102 also eliminates the possibility of transferring any significant earth loads from the wall backfill to be transferred to the full height panel 30. The continuous placement of the closure blocks 90 at the top of the separate M.S.E. wall 8 and in contact with the back face 33, of the full height panels 30, results in an essentially negligible load condition on the panels 30. The ability of the present invention to use essentially non structural, fascia panels for the wall facing is a unique and cost savings attribute of the present invention.

Alterative Embodiments

Figure 7:
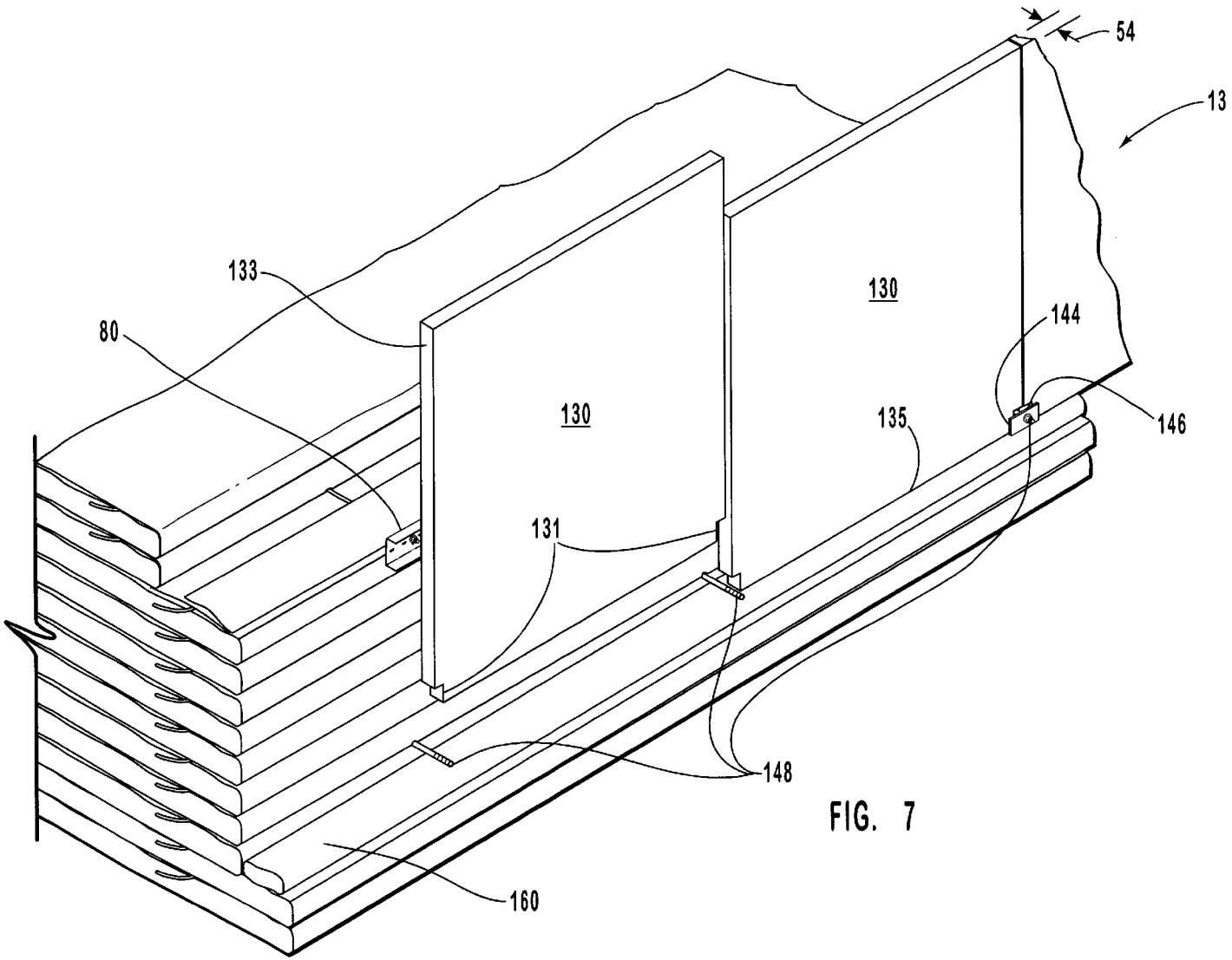
FIG. 7 is an isometric view of the panel installation of a remote, elevated, foundation beam wall assembly.
Figure 8:
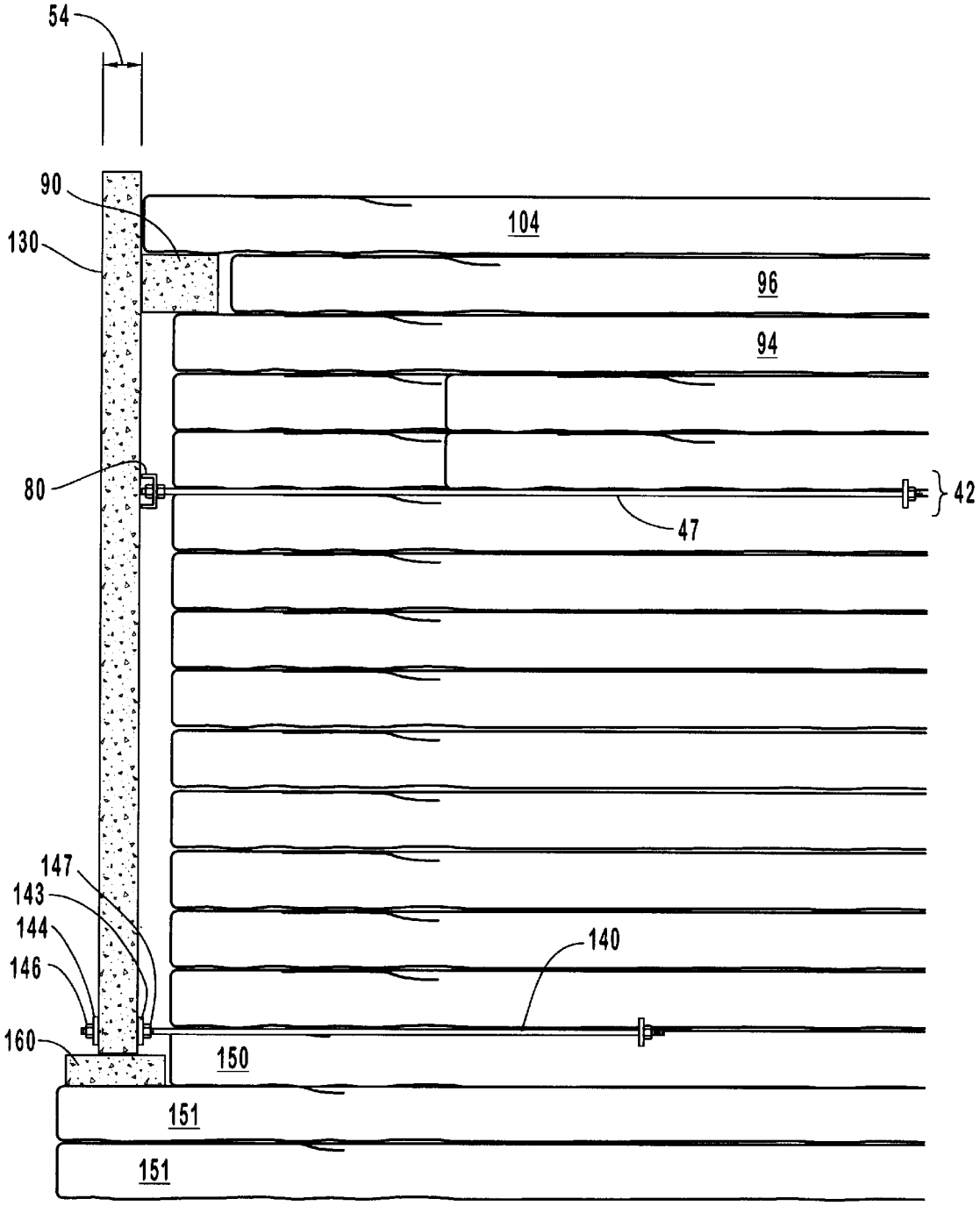
FIG. 8 is a section view through a completed remote, elevated, foundation beam wall assembly showing the panel attached to the separate layered, confined fill MSE wall;.

Referring now to FIGS. 5 through 8 a full height panel retaining wall system is shown under construction and is generally designated as 13. FIG. 7 is a cut-away perspective that illustrates the manner of construction of the retaining wall system. In general the retaining wall system 13 comprises an assembly of pre-cost wall panels 130 being restrained from movement by lower tie rods 140 which are restrained from outward motion by rear plates 61.

Figure 5:
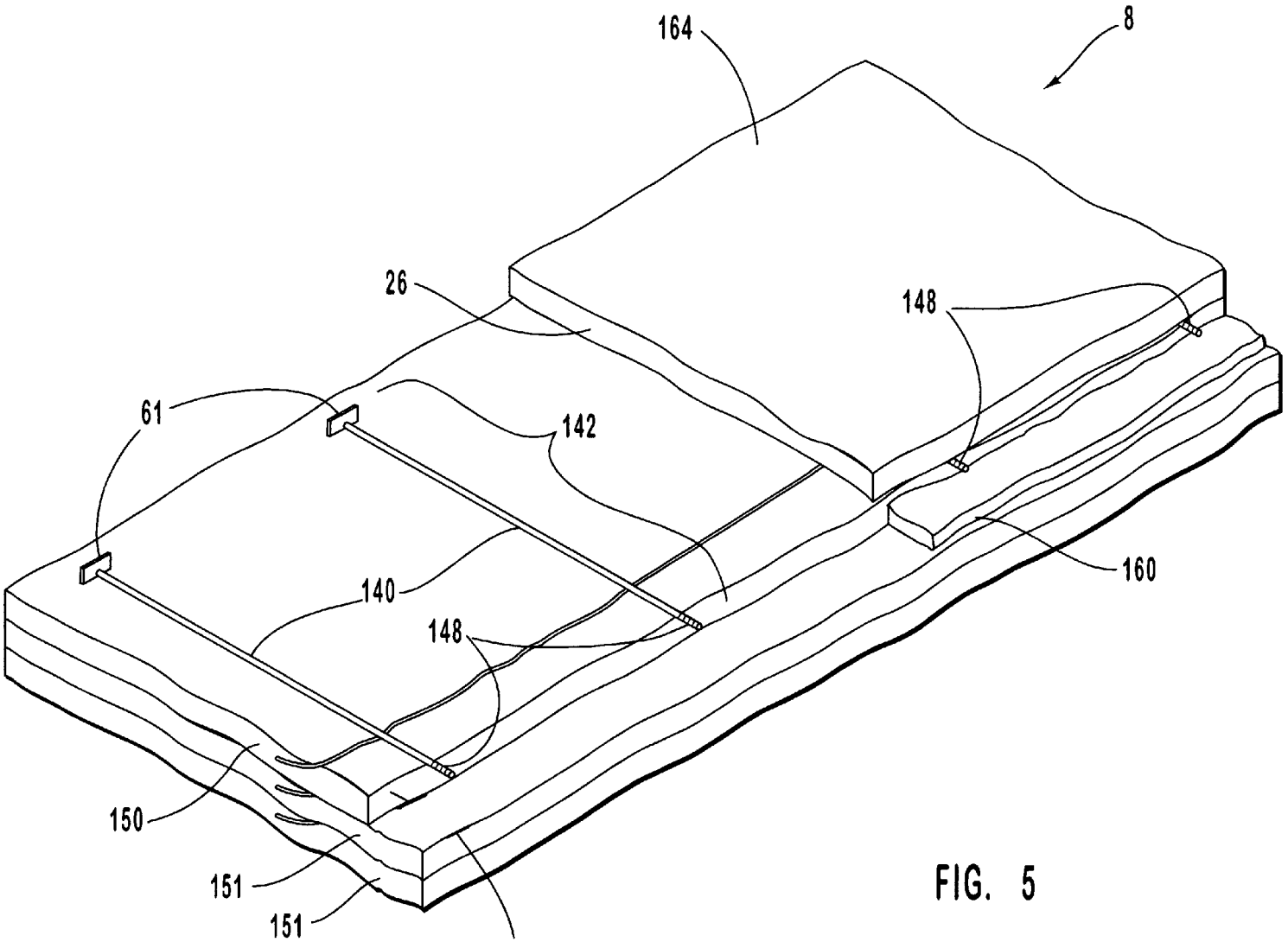
FIG. 5 is an isometric view of a remote, elevated, foundation beam wall assembly under construction showing lower tie rod and foundation beam installation.
Figure 6:
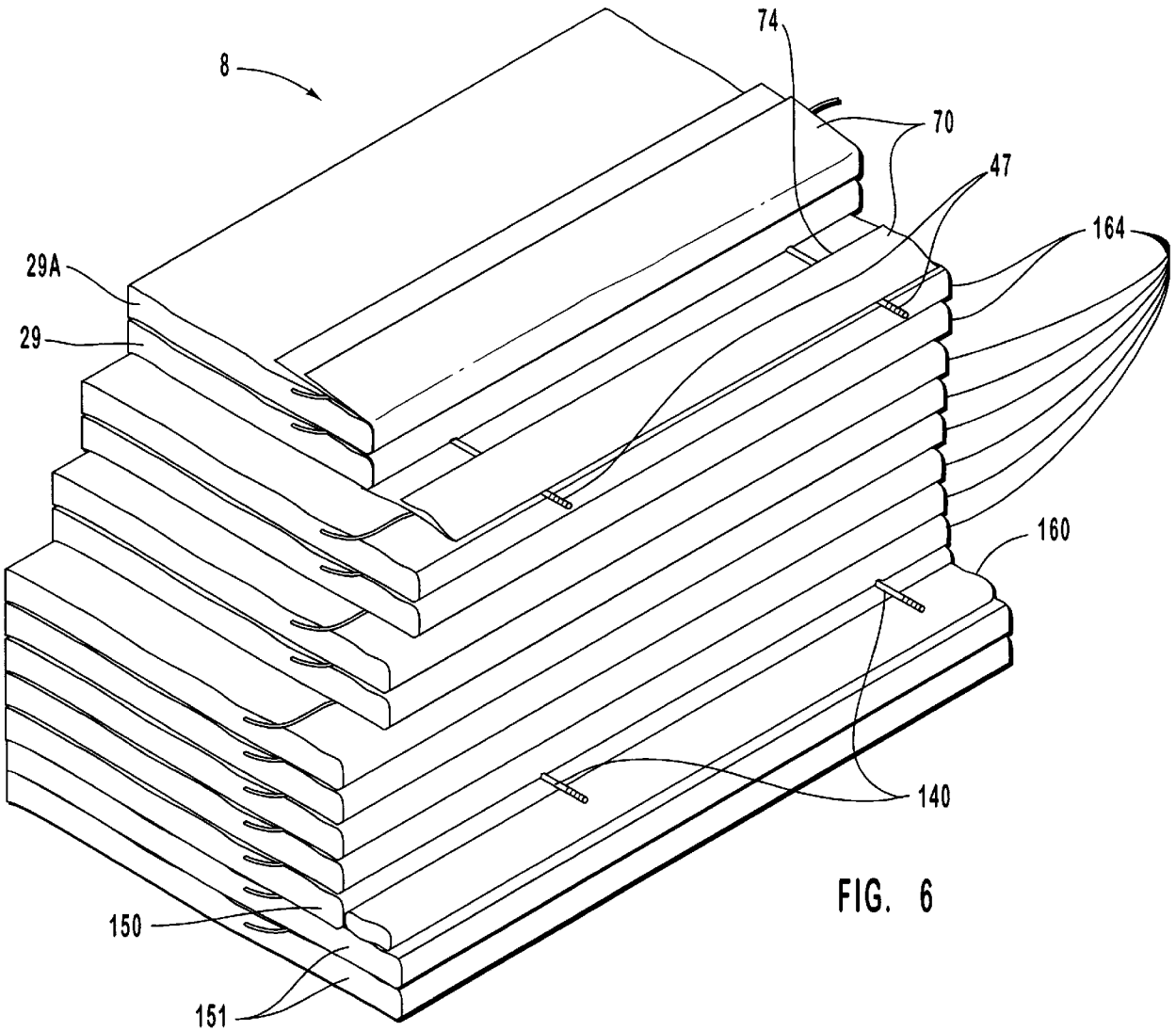
FIG. 6 is an isometric view of a remote, elevated, foundation beam wall assembly showing the upper tie rods installed at the work platform elevation.

FIG. 5 is an isometric representation of the initial construction stages of the wall system 13. The lower tie rod/plate assembly 142, which is comprised of the base tie rod 140, front plate 144, and nut 146 that is attached to the front threaded end 148 of the base tie rod 140, is shown in FIG. 5 placed on top of the first midwall confined fill layer 150 of the separate M.S.E. wall 8. The mid wall confined fill layers 164 are placed over and behind the offset confined fill layers 151. The front threaded end 148 of the lower tie rod 140 is shown extending out in front of the base confined fill layer 150. The lower tie rod assemblies 142 are shown placed on the base confined fill layer 150 displaced horizontally. This horizontal displacement 152 corresponds to the full height panel width 54. Shown placed on top of the last offset confined fill layer 151 is the cast-in-place concrete base beam 160. The base beam 160 is shown continuously constructed on top of the last extension confined fill layer 151. The base beam 160 can be cast after or prior to the installation of the lower tie rod assembly 142 installation and can either be continuous or intermittent. The ability of this embodiment of the present invention to provide for an elevated, remote panel foundation beam 160, supported by extension confined fill layers 151 of the separate M.S.E. wall 8 is one of the unique and cost savings advantages of the present invention compared to the wall systems currently available. By supporting the panel 160 on extension confined fill layers 151 the potential for future wall panel 130 settlement with respect to the separate M.S.E. wall 8 is minimized with this embodiment of the present invention.

Following placement of the lower fie rod assemblies 142 and the base beam 160, the mid wall confined fill layers 164 of the M.S.E. wall 8 are installed. When the mid wall confined fill layers 164 are completed up to the work platform 74, the remainder of the construction of the separate M.S.E. wall 8, along with the placement of the upper fie rod assemblies 42 proceeds as previously described for the preferred embodiment of the present invention.

The installation sequence of the full height wall panels 130 is shown in FIG. 7. The panel 130 is placed over the lower tie rod front threaded ends 148. The corner blockouts 131 at each side 133 on the bottom edge 135 of the panel 130 are shown with the front threaded end 148 of the lower tie rod 140 protruding out in front of the panel 130 at the panel vertical edge 133. If it is advantageous for panel 130 placement of a lower tie rod back plate 143 and the back nut 147 can be placed on the lower tie rod 140 prior to panel 130 placement. The addition of a plate 143 and nut 147 eliminates the need for shims(not shown) that would otherwise be required for proper plan alignment of the panel 130. The front plate 144 is forced against the face of the panels 130 at the joint by screwing the front nut 146 to the proper torque. The vertical position of the panel 130 is stable following the front plate 144 installation. With both panel tie rods 140 and 47 installed and attached to the panel 130, the crane lines (not shown) can be removed from the free-standing panel 130 which is held in place without the use of temporary erection braces.

The remaining top confined fill layers 94 & 96, the closure blocks 90, and unconfined wall backfill 104 can be installed as previously described for the preferred embodiment.

Figure 9:
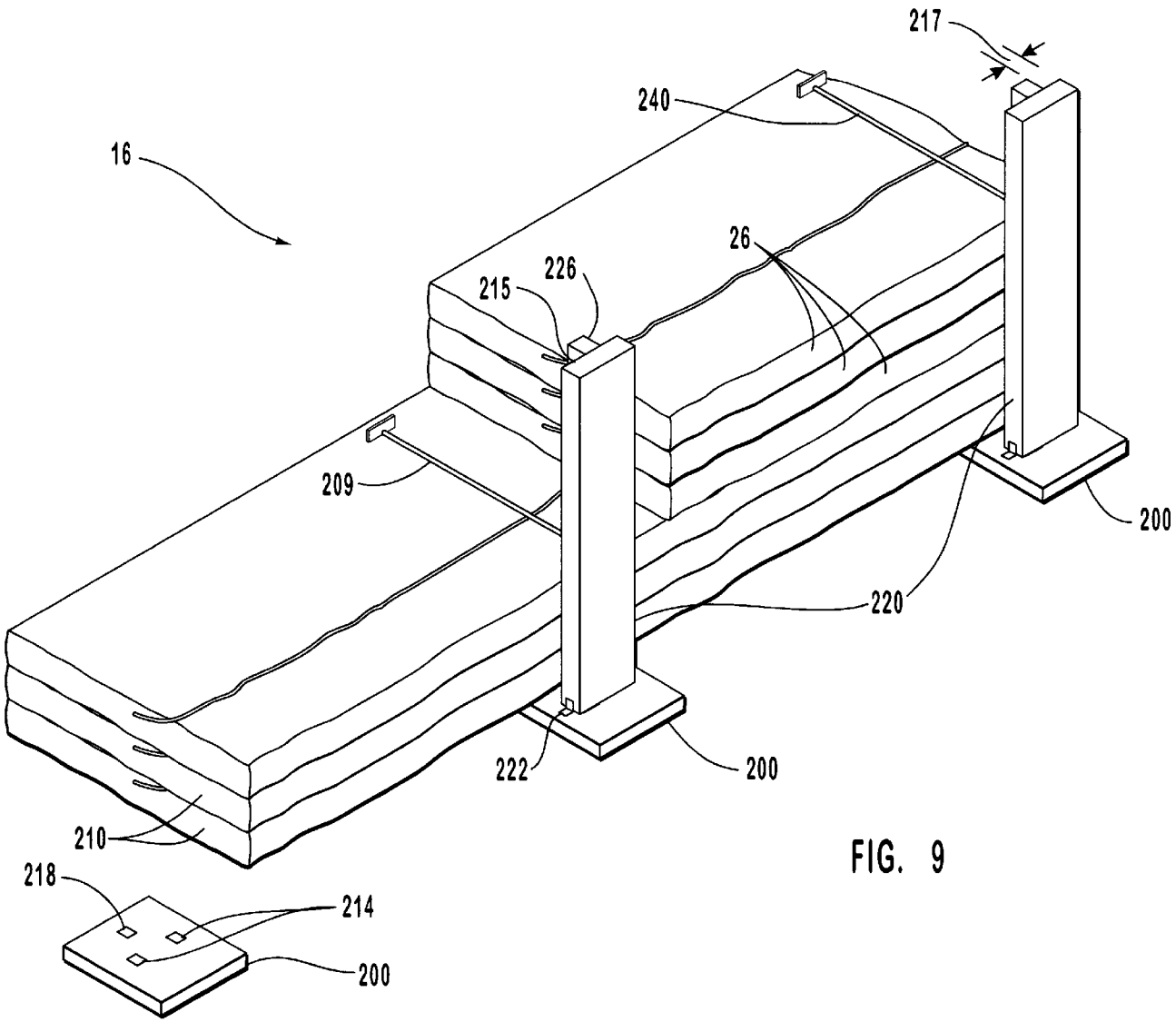
FIG. 9 is an isometric view of a vertical column wall assembly installation showing, in sequence, from the left side of the drawing, the foundation pod, vertical column, and tie rod installation.

Another wall architectural facing that can be used with the present invention is the vertical column panel support configuration. A wall utilizing this wall face is shown under construction and is generally designated as 16. FIG. 9 is an isometric drawing that illustrates the construction sequence of wall 16.

Prior to constructing the separate confined fill, layered M.S.E. wall 8 portion of the wall system 16, the concrete column foundation pads 200 are cast in the field at locations corresponding to the column spacing shown in the design. Following the placement of the pads 200, the first base confined fill layers 210 of the separate M.S.E. wall 8 are typically installed parallel to the grade at the top of the wall as shown in FIG. 9. Following installation of the first few confined fill layers 210, the lower column tie rod 209 is placed on top of a base confined fill layer 210. The location of the lower tie rod 209 corresponds to the horizontal spacing of the center lines of the vertical column supports 220.

Prior to placing the vertical columns 220, a number of the mid wall confined fill layers 26 may be optionally placed over the lower tie rod 210. The weight of these confined fill layers 26, over the lower tie rod 209, constrains the tie rod 209 from any motion. This wall construction sequence may be advantageous for tall support columns 220 since the immobile lower tie rod 209, when connected to the column 220 eliminates, the need for temporary erection braces (not shown) to provide additional stability to the column 220.

Figure 9A:
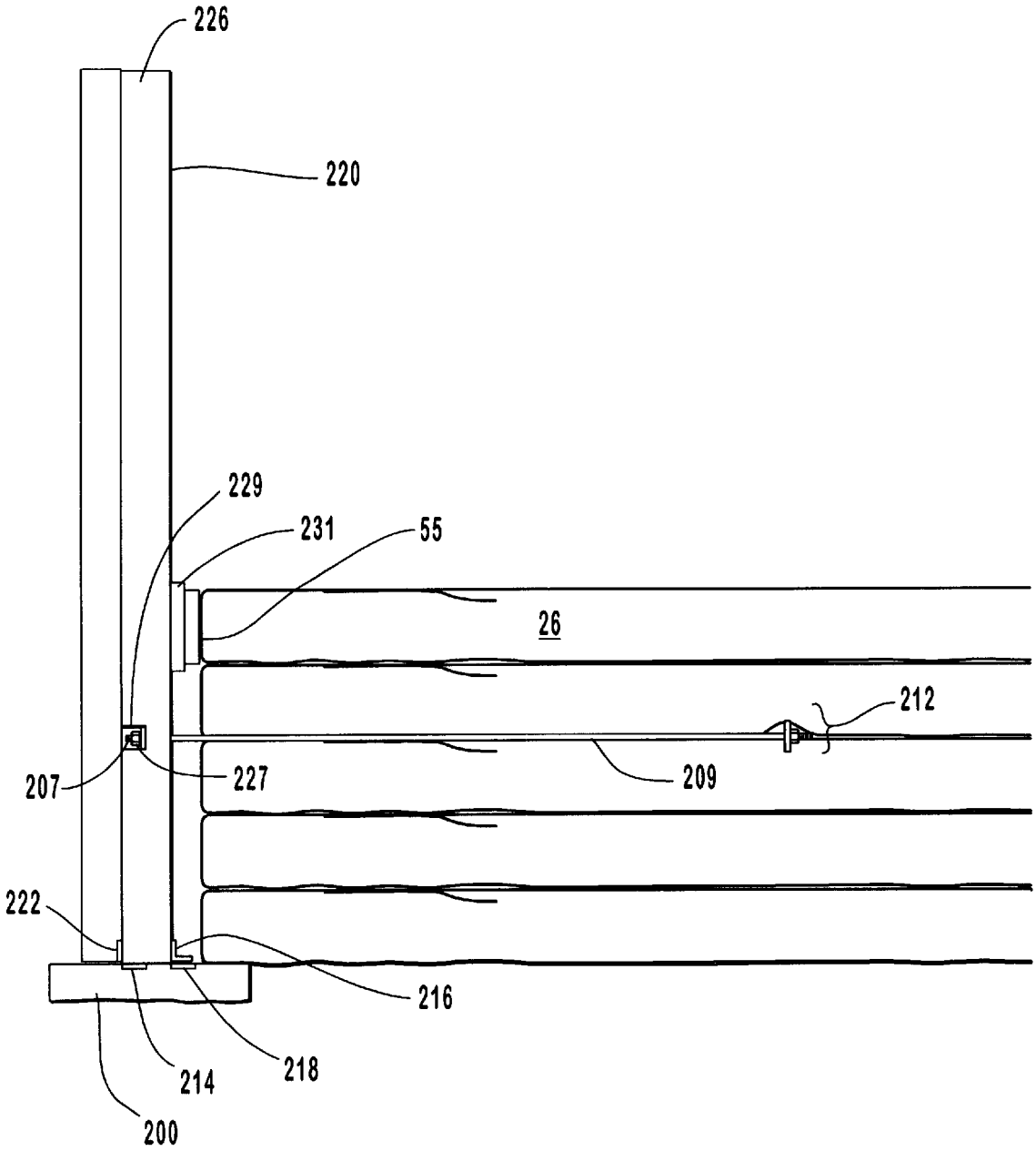
FIG. 9A is a section through the wall assembly described in FIG. 9 showing the use of vertical column connected to a lower tie rod acting as a form support for the face of the separate MSE wall.
Figure 9B:
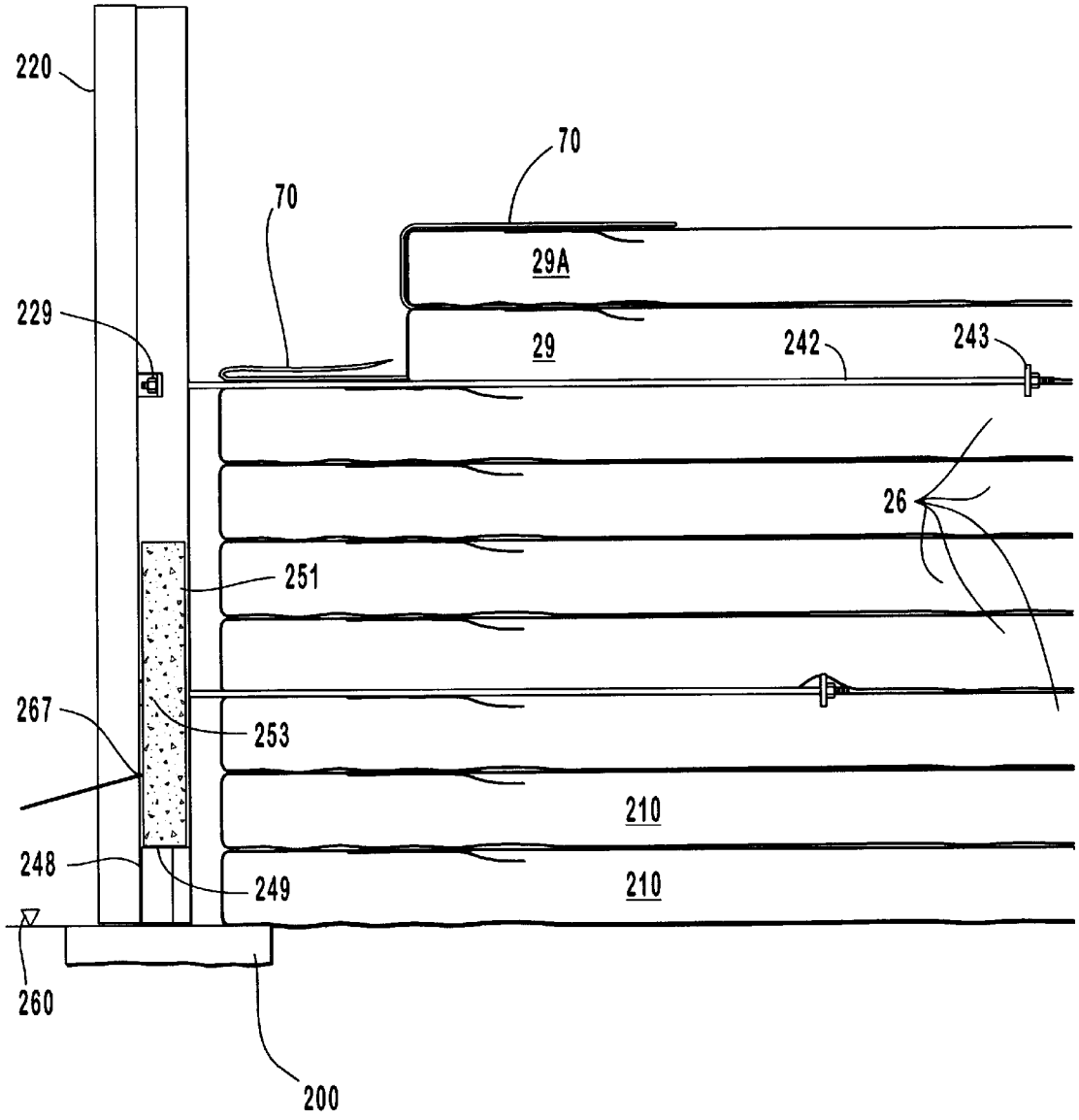
FIG. 9B is equivalent to FIG. 9A showing an installed panel and an upper tie rod installation and attachment to the vertical column.
Figure 9C:
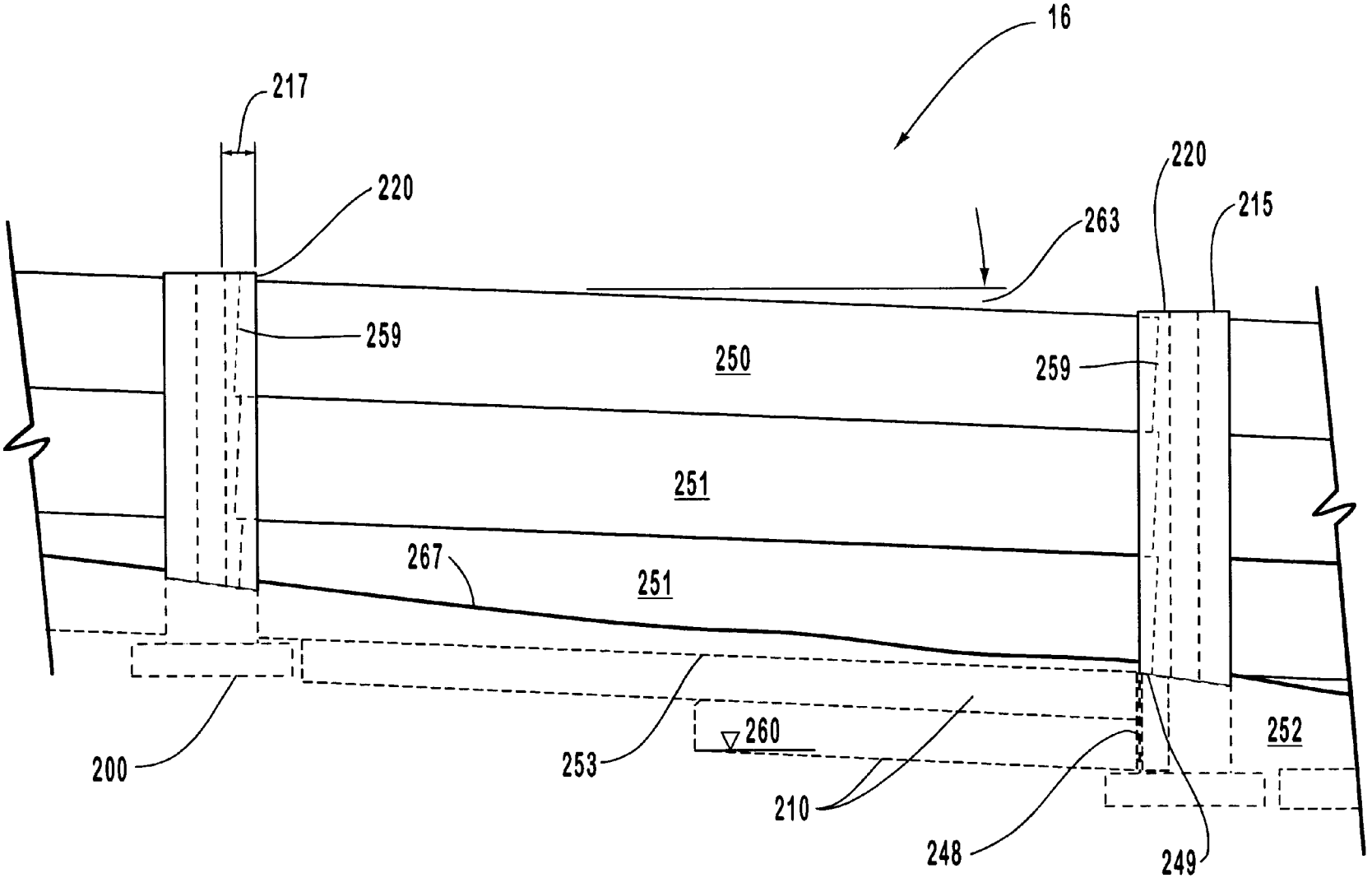
FIG. 9C is a partial elevation view of a completed vertical column wall system.

FIGS. 9A,9B and 9C are wall sections that show an alternate construction sequence. The columns 220, for this wall construction method, prior to installing the lower tie rod/plate assemblies 212, are held in a vertical position by crane lines (not shown) while the front flange weld plates 222 are welded to the foundation flange weld plates 214 and the web weld plate 216 is welded to the foundation pad web weld plate 218. Following the attachment of the weld plates 214, 216, and 218, the lifting lines (not shown) can be removed and the column 220 will remain in a stable vertical position. Various other attachment methods such as utilizing bolts or other fasteners (not shown) to attach the vertical column 220 to the foundation pad 200 are acceptable and not in conflict with the operation of this embodiment of the current invention if expedient for construction of the specific wall application. The lower tie rod 209 is shown with the front threaded end 207 inserted into the counterbore access void 229 cast into the web 226 of the vertical column 220. The securing front nut 227 is shown threaded onto the front threaded end 207 of the lower tie rod 209 in the counterbore access void 229 cast into the web 226 of the vertical column 220 in FIG. 9B.

If, in the wall construction sequence, the vertical columns 220 are placed following the installation of the lower tie rod 209, the vertical support columns 220 are held in a vertical position by a crane or other lifting device and the vertical support columns 220 are slid or barred back into position with the front threaded end 207 of the tie rod 209 inserted into the lower counterbore access void 229 in the back web 226 of the vertical column support 220. Either weld plates 214 & 218 or bolts (not shown) are used to solidly attach the vertical column support 220 to the pad 200. The securing nut 227 can now be placed into the access void 229 and threaded onto the front threaded end 207 of the tie rod 209. After the nut 227 is tightened, the crane lines can be removed from the vertical support column 220. Since the vertical support column 220 is anchored at the pad 200 and at the lower tie 209, there is typically no need for erection braces (not shown) or additional supports to stabilize the vertical support column 220.

Additional midwall confined layers 26 can now be installed. The vertical column supports 220 are now stable they can be used as a vertical alignment brace for horizontal face forming struts 55. The strut 55 is shown in section in FIG. 9A and can be used in conjunction with elastomeric spacer blocks 231 to act as an effective form for the face of the confined fill layers 26 as they are installed. This multi-function of the vertical column support 220 is one of the unique features of this embodiment of the present invention. The horizontal strut 55 eliminates the need for other face forming methods that would otherwise be required to maintain the proper alignment of confined fill layers 26.

When the midwall confined fill layers 26 reach the upper tie rod 242 elevation the upper fie rod assembly 240 is placed on top of the midwall confined fill layer 26. As with all embodiments of the present invention the rear anchor plate 243 is placed within the passive zone of the wall backfill. Additional work platform offset confined fill layers 29 and 29A can now be placed over the upper tie rod assembly 242. The remainder of the M.S.E. wall 8 and top unconfined fill layer 104 are installed in a similar manner that has been previously described for the other embodiments of the present invention.

Light weight, typically hollow core, prestressed concrete panels or a material of a comparable structural integrity are used for the facing units for this embodiment of the present invention and face panels 250 and 251 are shown in place in FIG. 9B and 9C. The generally horizontally disposed wall panels 250 can be placed between the vertical support columns 220 following the placement of the work platform offset confined fill layers 29 over either the upper tie rod assemblies 42. The base panel 251 is elevated above the base elevation of the separate MSE wall 8 by the use of spacer blocks 248 made of a high compressive strength material such as concrete. The top of the spacer blocks 249 correspond to the bottom edge 253 elevation of the base panel 251. The top of the spacer blocks 249 is above the bottom 260 of the M.S.E. wall 8, but below the proposed final grade elevation 262 in front of the wall 16. The bottom of panel 253 is elevated above the bottom of the M.S.E. wall 8 elevation a vertical upward displacement from the base of the separate M.S.E. wall 8 and this elevated panel base is a common feature of all embodiments of the present invention. By placing the base panel 250 or 251 of the wall system 16 above the bottom of the M.S.E. wall 8, the area of wall facing panels is less than the area of the M.S.E. wall 8 face. This unique feature of the present invention, which is typical of all embodiments of the present invention, allows the separate structural M.S.E. wall 8 to be at the proper depth for geotechnical stability without requiring the bottom of face panels 250 or 251 to be at the same elevation.

Another feature of this embodiment of the present invention that is shared by all embodiments of the invention is that the face panels 250 are typically placed parallel to the grade at the top of the wall. One distinguishing feature between this embodiment and the other embodiments of the present invention is that the panels for this embodiment are typically rectangular in shape rather than the typical parallelogram panel shape which is the case for the other embodiments of the present invention. By using varying heights of spacer blocks 248 as shown in FIG. 9B and 9C, the assembly of wall panels 250 will follow the grade at the top of the wall. The panels 250 will follow the grade at the top of the wall and the bottom edge 253 of the bottom panels 251 will be above the base elevation 260 of the M.S.E. wall 8. Rectangular shaped face panels 250 can be utilized for this non-horizontal orientation and still have support and cover on the right angle (normal) panel edges 259 due to the fact that the face flanges 215 of the vertical columns 220 are of adequate width 217, as shown in FIG. 9C, to cover the vertical edges 259 even though the vertical edges 259 are orientated at a grade angle 263 that is perpendicular to the grade at the top of the wall rather than corresponding to the vertical orientation of column web 226. This feature of this embodiment of the present invention allows this embodiment to utilize inexpensive rectangular precast panels that are mass produced to be used as facing elements even though these panels are typically used for other applications such as precast fencing panels or for soundwall applications. Since the overall wall heights typically vary and due to the fact that the top of wall and the slope intercept or proposed grade in front of the wall 267 shown in FIG. 9C are not parallel, the use of varied width panels 251 is typically required to be used with face panels 250. The mass produced panels previously shown used for facing units 250 for this embodiment of the present invention are typically a hollow core prestressed panel with a significant void percentage at the panel cross section. This results in a light weight panel which allows the vertical columns 220 to be displaced from adjacent column members at large distances compared to the column 220 spacing that would be required for solid panels 250 of a similar material. This results in fewer tie rod assemblies and is one of the cost advantages of this embodiment of the present invention.

For all face panel 250 installation methods, following placement of the base panel 251, compressible foam blocks, or a comparable material, (not shown) are wedged between panel 250 and the front face of the M.S.E. wall 8 to prevent the panels from leaning back away from the vertical column 220 flanges 215. All of the subsequent upper panels 250 are placed between the vertical column supports 220 in a similar manner wherein the normal angle edges 257 of the panel 250 are supported by the back of the face flange 215 of the vertical support column 220.

Following installation of the confined fill layers 26 over the upper tie rod assembly 42, the remaining wall installation methods for this embodiment of the present invention proceed in a similar manner to what has been stated for the other embodiments of the present invention.

In yet another optional embodiment of the present invention an adjustable panel connector 300 is provided to allow for the horizontal adjustment of the wall face if required to correct wall deformation or alignment deviations following and due to the effects of a seismic event. M.S.E. wall structures 8 utilizing geotextile material for tensile inclusion members for soil reinforcement have exhibited excellent resiliency and stability during seismic events. This is primarily due to the flexible nature of the geotextile material. The ability of the confined fill layers to accommodate short duration high loading conditions by restraining the soil as the soil reinforcement layers deform without rupture to relieve the induced material stresses is one of the advantages of using confined fill layers utilizing geotextile for tensile inclusion members for soil reinforcement. Although the earth retention structures built in conformance to the present invention would typically be in place following a seismic event, due to the flexible nature of the geotextile soil reinforcement, a permanent overall deformation of the structures can result from the high horizontal accelerations experienced during an earthquake. The visual indication of these deformations can be a horizontal displacement of the facing elements with respect to a vertical plane.

One of the unique features of the present invention is the ability of the facing units 30 or 130 to be displaced back into a vertical plane without having to remove and reconstruct a substantial portion of the separate the MSE wall 8 prior to displacing the panels 30 or 130 back to a vertical orientation. The embodiments of the present invention that can utilize the advantage of the adjustable panel connector are wall systems 10 and 13.

Figure 14:
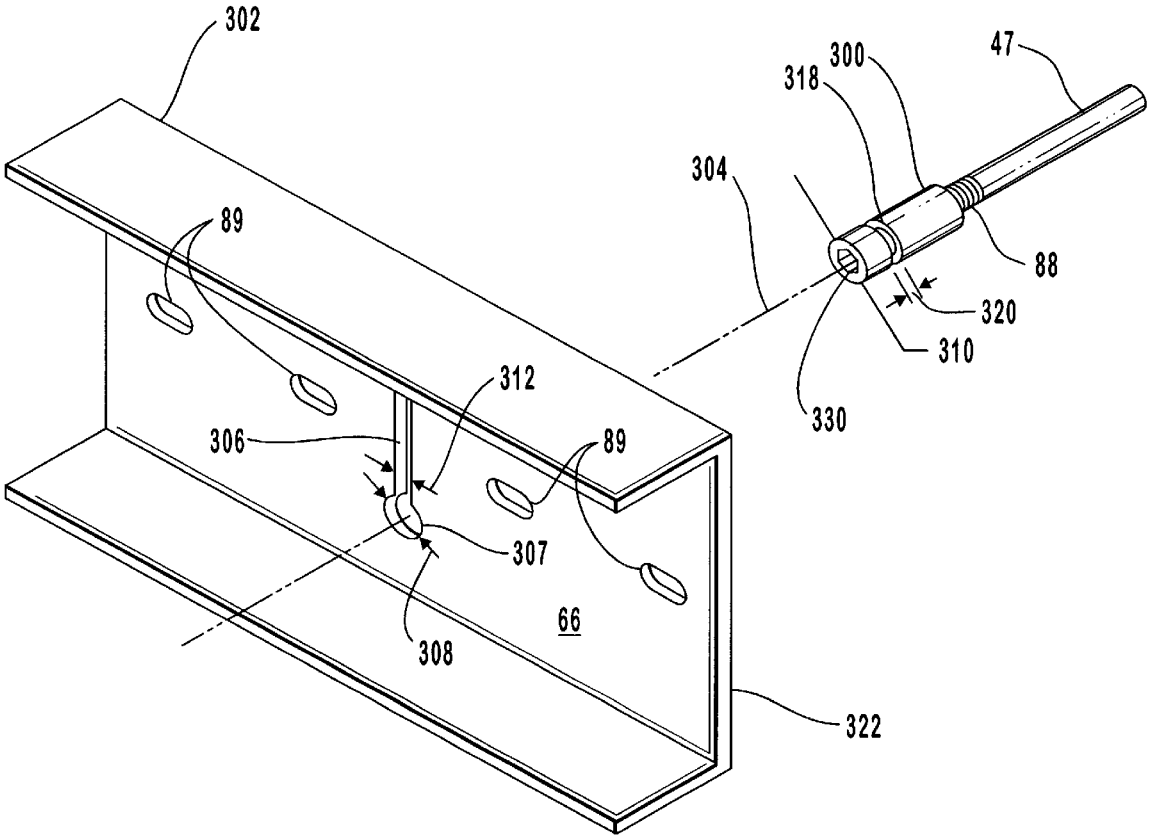
FIG. 14 is an isometric view showing the installation, at the adjustable channel connector projected centerline, of a grooved horizontally adjustable panel connector.

For walls that are placed in an area where the possibility of seismic loading is anticipated, the option of using an adjustable threaded panel connector 300, in lieu of the typical front securing nut 84 on the upper tie rod 47, provides a method to realign the facing panels 30 or 130 should the panels move with the separate MSE wall 8 due to high horizontal accelerations. FIG. 14 shows an adjustable panel connecting channel 302 and an adjustable threaded panel connector 300. The adjustable threaded panel connector 300 is shown oriented on the isometrically projected centerline 304 of the circular hole 307 at the bottom of the vertical slot 306 cut into the adjustable panel connecting channel 302. The diameter of the circular hole 308 is slightly greater than the outside diameter 310 of the adjustable panel threaded connector 300. The width 312 of the vertical slot 306 is slightly less than the outer diameter 310 of the adjustable panel threaded connector 300. The width 312 of the vertical slot 306 is additionally slightly greater than the inner diameter 316 of the groove 318 cut into the adjustable threaded panel connector 300. The width of the groove 318 is also slightly greater than the web thickness 322 of the panel connecting channel 302. By sizing the groove width 320, the vertical slot 306 and the circular hole 307 as stated the adjustable threaded panel connector 300 can be inserted in the circular hole 307 and then moved upward by a vertical displacement 324. The adjustable panel connector 302 groove 320 restrains the panel 30 or 130 from horizontal displacement since the sides of the groove 326 overlap and are in contact with the vertical slot 306 in web 66 of the adjustable panel connecting channel 302.

Figure 15:
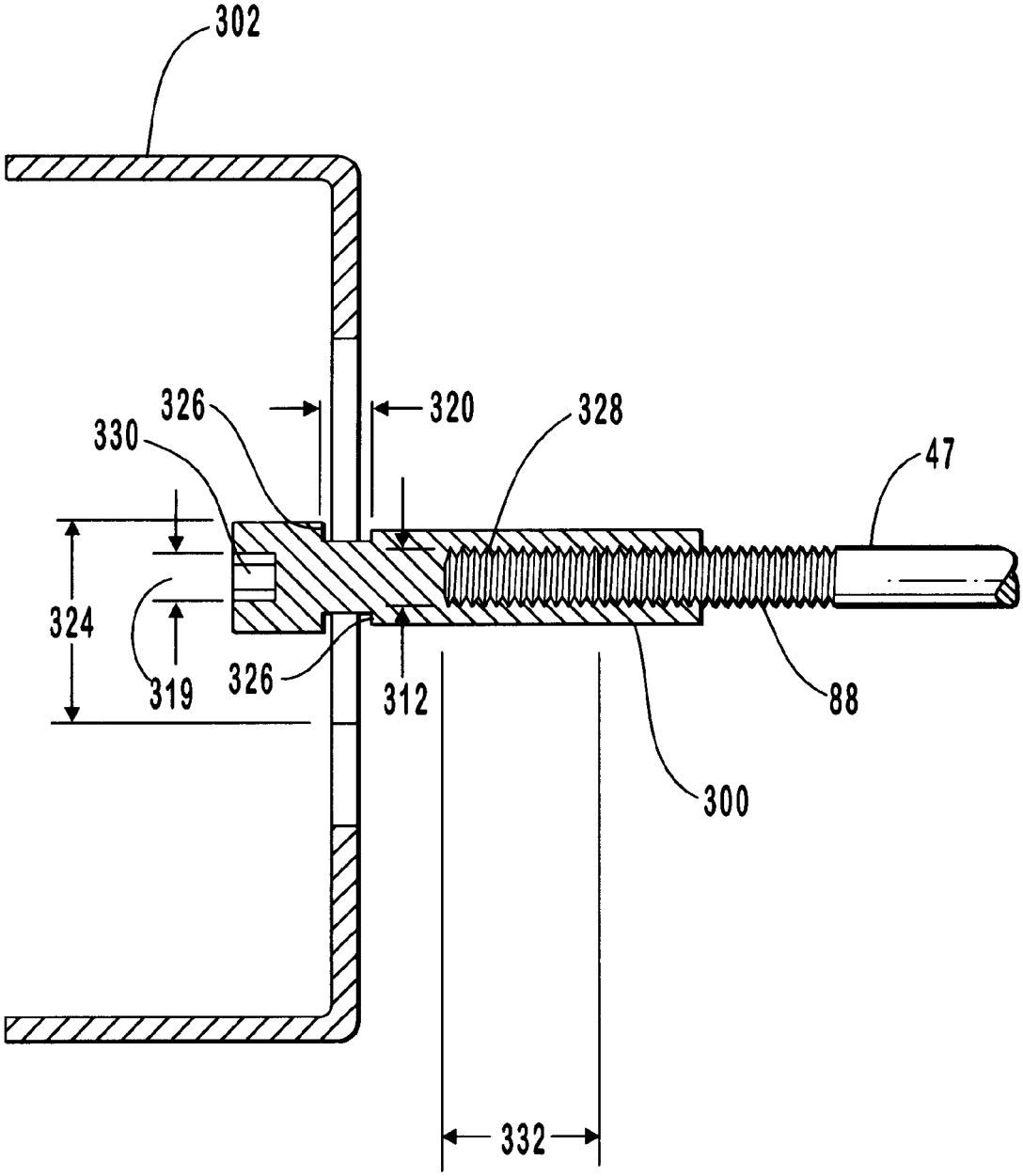
FIG. 15 is a vertical section through a channel connector attached to an adjustable panel connector showing the potential horizontal adjustment distance with respect to the front of the upper tie rod.

The adjustable threaded connector 300 is shown in section inserted into the vertical slot 306 in FIG. 15. The front threaded end 88 of the upper tie rod 47 is also shown in FIG. 15 partially threaded into the interior threads 328 of the adjustable threaded panel connector 300. The adjustable threaded connector 300 would typically be threaded onto the tie rod 47 manually in the field at the proper horizontal location corresponding to the vertical panel position. The panel connecting channel would subsequently be connected to the panel 30 or 130 as previously described for all other embodiments of the present invention.

Referring again to the isometric portrayed in FIG. 14 shows a hexagon shaped counterbore 330 at the front of the adjustable threaded panel connector 300. The hexagon counterbore 330 would typically be sized to correspond to conventionally available allen head wrenches which are hexagonal in shape. The maximum width 319 of the hexagon counterbore 330 is sized so as not to exceed the typical horizontal distance between the vertical panel joint 331 between the facing panels 30 or 130. In the event of a panel being displaced from a vertical orientation a hexagonal shaft, sized to correspond to the hexagon counterbore 330, can be inserted between adjacent facing panels 30 or 130. As a result of turning the hexagonal shaft, the adjustable threaded panel connector 300 will be displaced horizontally a maximum distance 332 as shown in the vertical section in FIG. 15. The facing panel 30 or 130 will therefore displace a corresponding horizontal distance since the web 66 of channel 302 is engaged with the adjustable threaded connector at the groove 318 of the adjustable threaded connector 300. Prior to the initial panel displacement, it will typically be necessary to remove the top layer of unconfined fill and the closure block 90 from behind the wall panel 30 or 130. This is a minor amount of material removal and is quite economical to remove and replace compared to the major reconstruction that would be required for any other wall system currently available should those systems be subjected to significant seismic events resulting in deformation. The ability to realign the wall face without wall replacement is one of the unique and cost effective advantages of the current invention.

Operation of Invention: Stationary Wall Face Attached To Separate Flexible Mechanically Stabilized Earth Wall.

Figure 10:
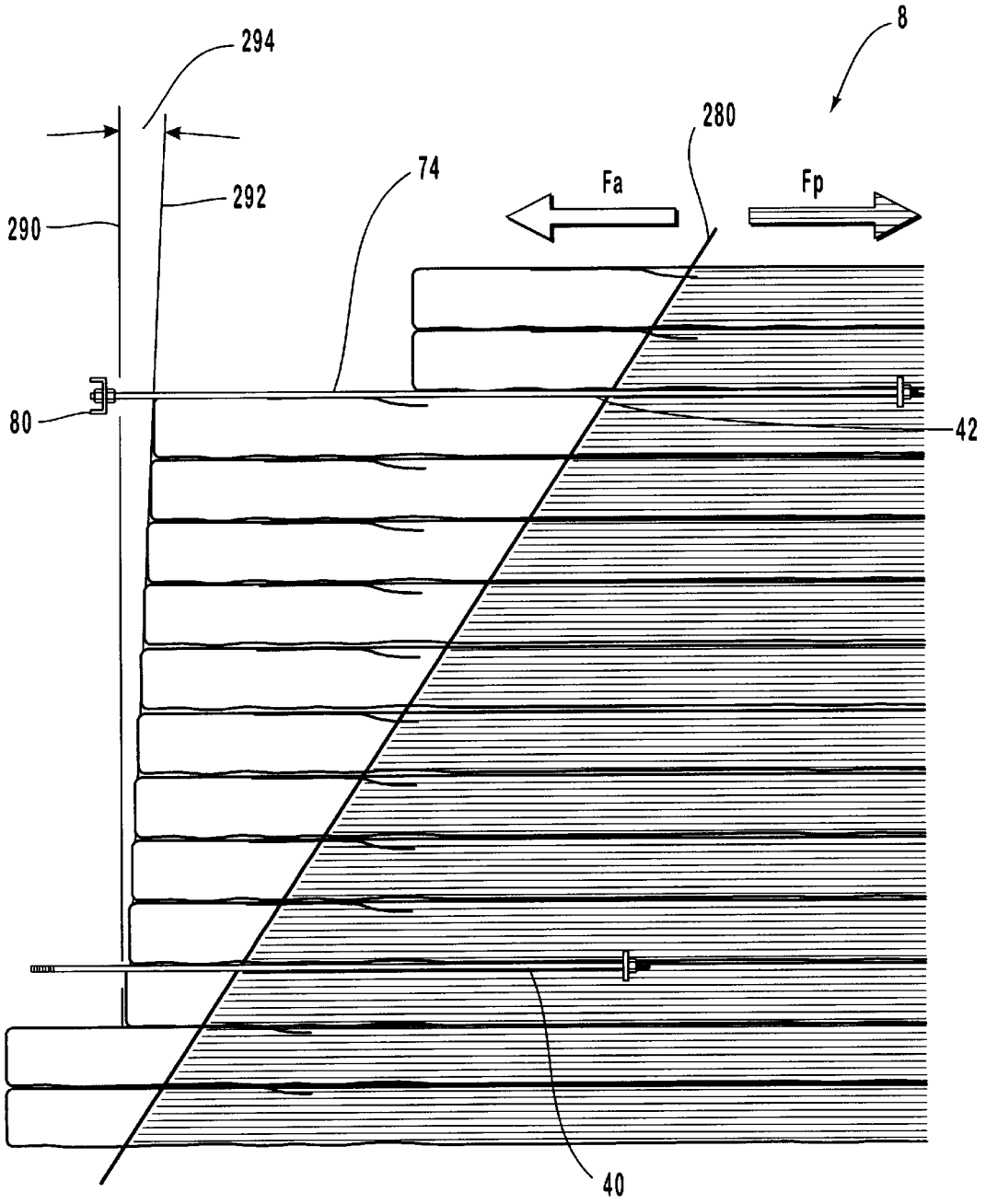
FIG. 10 is a cross sectional schematic illustrating the opposing loads acting on either side of an active failure plane and the initial wall batter of the MSE wall.

Referring to FIG. 10, which is a vertical cross-section taken through a typical layered confined fill retaining wall 8, a failure plane 280 is shown oriented at an angle of 45 degrees+$\phi/2$ where $\phi$(phi) is the angle of internal friction of the backfill material for the MSE wall 8. The confined fill layer length and vertical spacing of the layers are determined using an accepted MSE wall stability analysis such as the Rankine method. The concentrated forces that act on the tie rod are evaluated by a static equilibrium approach for varying load conditions. For the confined, layered fill MSE wall 8 depicted in FIG. A the tensile inclusion material shown is a geosynthetic material although different materials such as geogrids can be used as soil tensile inclusion members for the MSE wall 8, and the some analysis will apply.

There are two earth pressure zones acting on opposite sides of the active failure plane 280. The front reinforced active earth pressure triangular shaped wedge, represented by the bordered arrow Fa, is restrained from motion by the passive earth restraining forces, represented by the shaded arrow Fp, which act on the soil shown in the passive wedge behind the failure plane 280. The dimensions of the earth pressure zones and the overall stability of the MSE wall 8 are typically determined by using a tied back wedge approach. In all embodiments of the present invention the tie rod length is sufficient so that the rear end of the tie rod which is connected to the anchor is within the passive wedge and behind the active failure plane 280.

The vertical reference line 290 and initial wall batter line 292 are shown in FIG. 10 which is a vertical section view of a typical confined layered fill MSE wall 8. These reference lines 290 and 292 are shown intersecting at the base of the MSE wall 8. The initial wall batter line 292 is offset from the vertical reference line 290 by the horizontal batter displacement 294.

The horizontal batter displacement 294 is determined in the geotechnical design used for the stability determination of the MSE wall 8 and it varies depending on the site wall loads, backfill material, and the type of geosynthetic tensile inclusion material used for the confined fill layers. The confined fill layers are constructed in the field to conform to the initial wall batter line 292 as closely as possible. The initial wall batter line 292 or the face of the MSE wall 8 will gradually move out or toward the vertical reference line 290 as the confined fill layers of the MSE wall 8 attain the design height. This slight horizontal deflection or strain is a manifestation of the stress of the induced earth loads in the confined fill layers of the MSE wall 8. The load in the confined fill layers increases as the design height of the MSE wall 8 is attained. Strain in the individual confined fill layers or creep as it is referred to in the industry is a phenomenon unique to geosynthetic reinforced MSE walls. The major portion of any horizontal movement of the MSE wall face towards the vertical reference line 290 will occur within the first few days following the completion of the MSE wall 8 up to the elevation of the work platform 74. The foregoing description will further clarify that although the MSE wall face will exhibit slight horizontal displacement per the site specific design, the position of the tie rod assembly 42 and the base of the wall will not move with respect to the vertical reference line 290. The ability of the present invention to compensate for internal movement of the separate reinforced MSE wall 8 without a resultant horizontal deflection of the final precast face is one of the unique features of the present invention. Other systems currently in use require that the anticipated horizontal wall face deflection be built into the wall as it is constructed which requires experienced field labor and extensive field time for construction.

Figure 11:
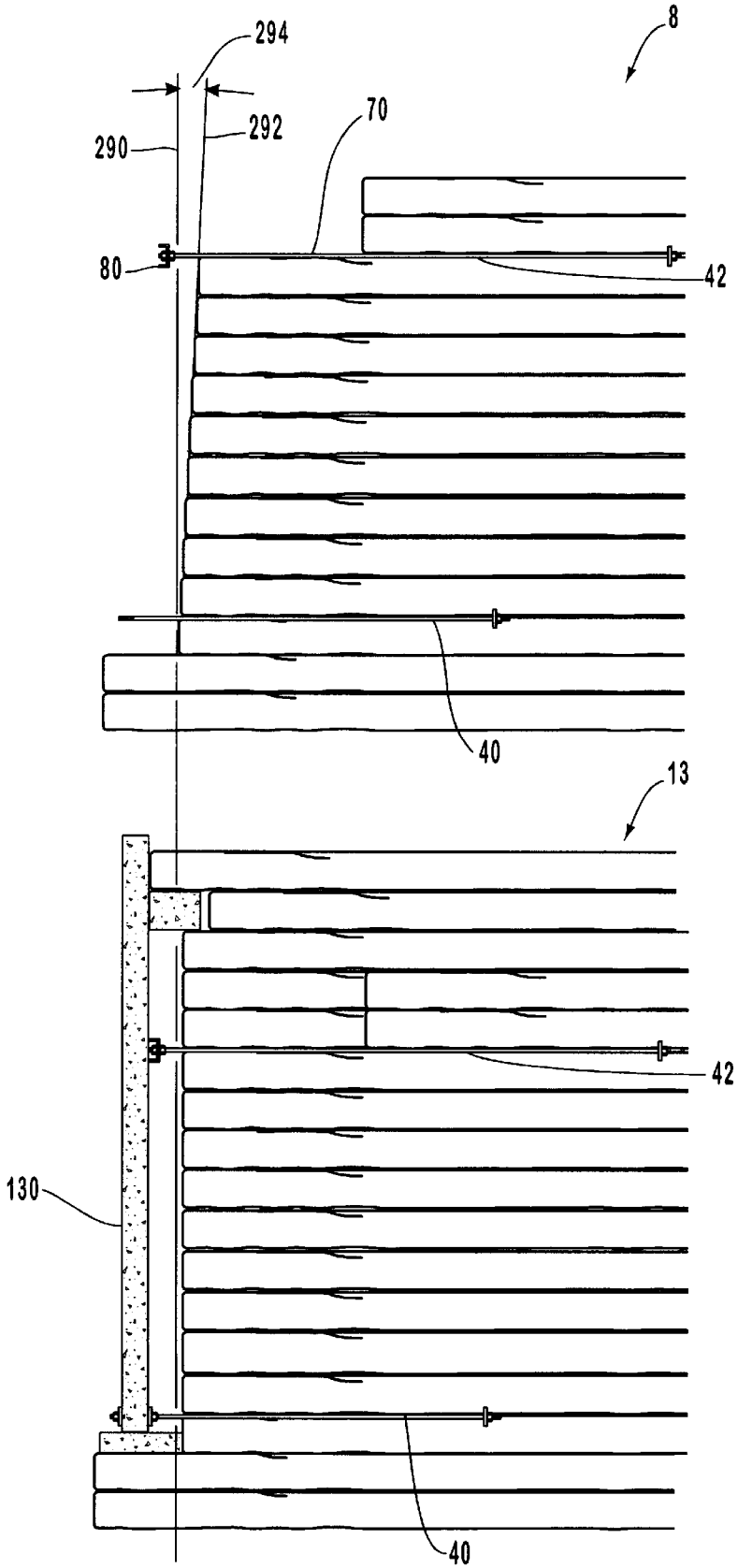
FIG. 11 shows the wall section as described in FIG. 10 and additionally shows a completed wall section on the lower half of the drawing without a batter inclination; additionally the two wall sections share a common vertical reference line at the face of the separate MSE wall.
Figure 12:
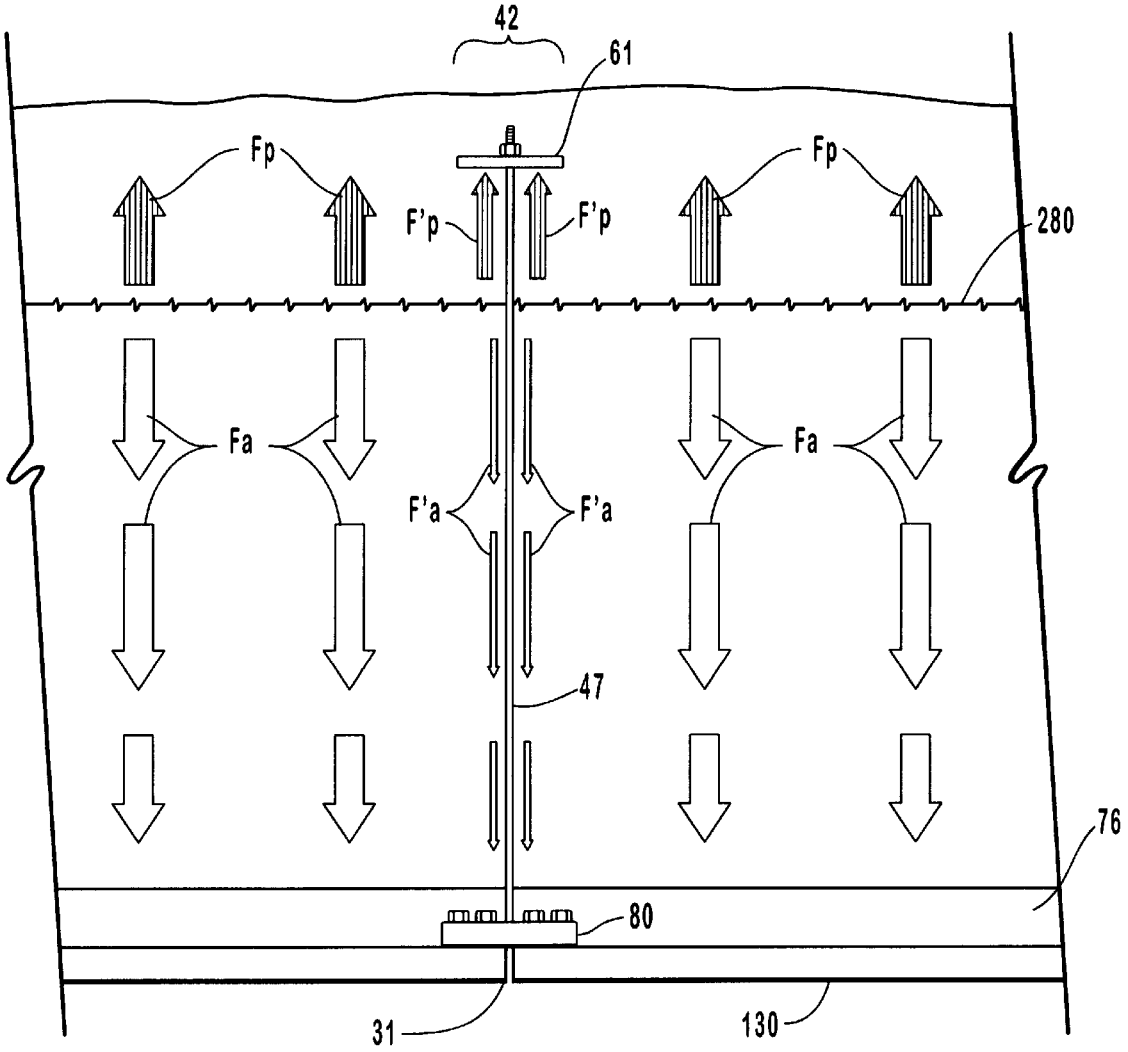
FIG. 12 is a horizontal schematic section of the lower wall section shown in FIG. 11 illustrating the forces and loads interaction on both sides of an assumed failure plane.

The composite vertical section through the wall in FIG. 11 shows the vertical reference line 290 continuing down from the upper wall section prior to horizontal deflection (previously shown in FIG. 10 ) at the face of the wall and intersecting the base of the MSE wall 8 following outward deflection of the MSE wall 8. The front channel connector 80 is shown in both the upper and lower wall sections shown in FIG. 11 and the channel 80 is in the some vertical plane corresponding to the vertical reference line 290. The significance of the stable position of the channel connector 80 is that the face of the MSE wall has moved outward a horizontal batter displacement 294 with respect to the horizontally stationary tie rod assembly 42. This relative movement of the MSE wall 8 with respect to the tie rod assembly is a unique feature of the present invention and allows the panels to be installed following the substantial completion of the MSE wall 8 although the MSE wall 8 may still exhibit creep following attachment to the MSE wall. FIG. 12 is a partial horizontal plan view of a typical upper tie rod assembly 42 at the vertical panel joint 31. The active earth pressure loads Fa and the correspond resisting forces Fp acting on either side of the assumed failure plane 280 are shown in FIG. 12. Also shown are the horizontal frictional loads F'a induced on the tie rod 47 from the confined fill layers above the tie rod assembly 42 and the resultant restraining force F'p imposed on the rear plate 61 by the confined soil above the tie rod assembly behind the assumed failure plane 280.

Figure 13:
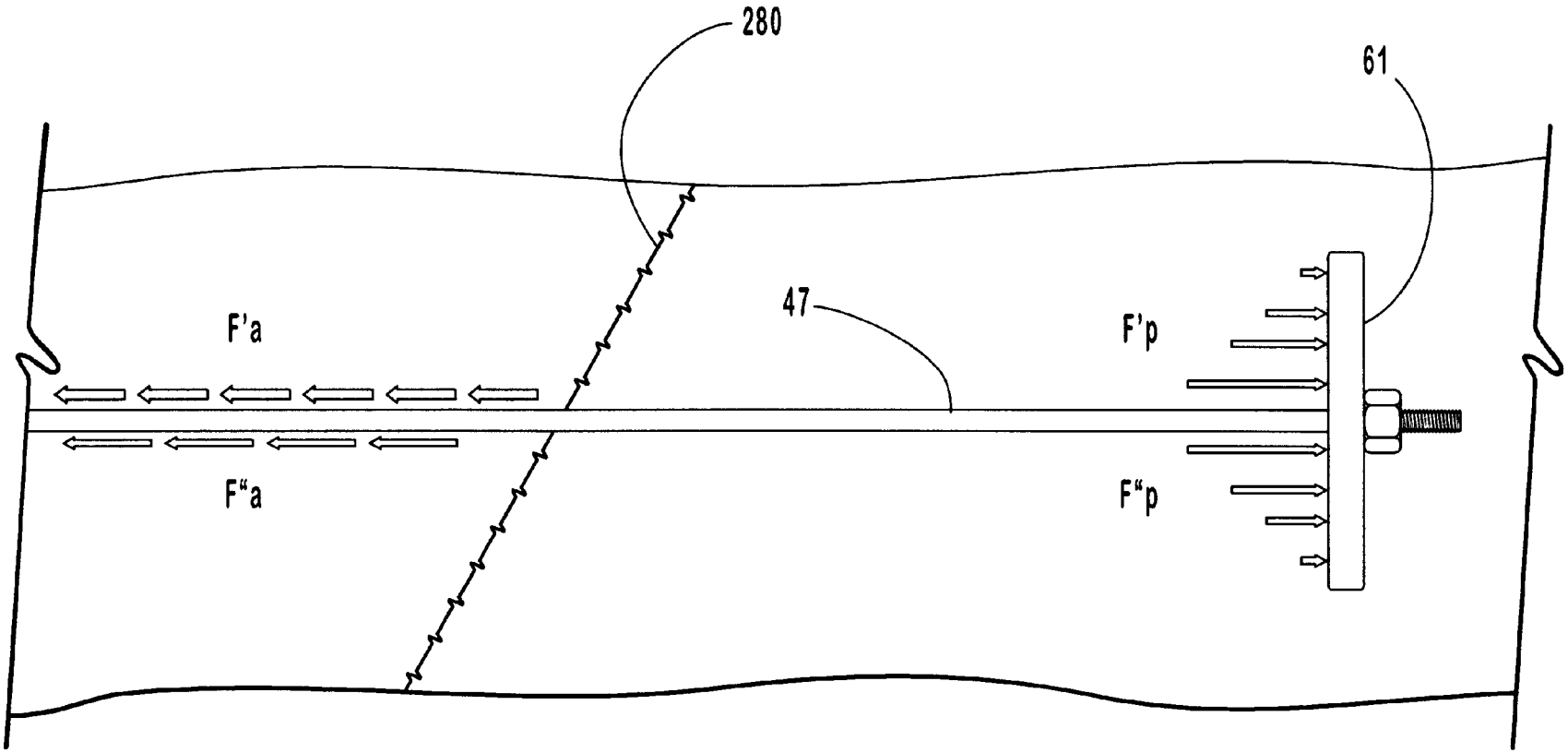
FIG. 13 is a partial vertical schematic section adjacent to an upper tie rod assembly illustrating the sliding friction loads and resisting forces on the tie rod/plate assembly.

FIG. 13 is a schematic freebody vertical section adjacent to an upper tie rod assembly 42 imbedded between confined fill layers in the separate MSE wall 8 and depicts the forces acting on the tie rod assembly 42 on either side of the assumed failure plane 280. The combined horizontal frictional loads F'a acting on the top of the tie rod 47 and the frictional loads F"a due to the incremental movement of the confined fill layer below the tie rod 47 in front of the assumed failure plane tend to move the tie rod assembly 42 outward toward the face of the MSE wall 8. This tendency of outward movement of the tie rod 47 is resisted by the opposing forces F'p and F"p induced on the rear plate 61.

The sum of the outward horizontal frictional loads F'a and F"a on the tie rod must be less than or equal to the opposing resisting force F'p and F"p induced on the rear plate 61. The surface of the tie rod 47(or oversized sleeve-not shown) is smooth exhibiting a low sliding coefficient of friction and the horizontal frictional loads induced on the tie rod 47 by the incremental movement of the confined fill layers in contact with the tie rod 47 in the assumed failure wedge therefore are minor. These loads F'a and F"a are negligible due to the low coefficient of friction between the smooth surface of the tie rod 47 and because the rod surface area is negligible compared to the contact area of the adjacent confined fill layers in contact with other above and below the tie rod 47. In addition, the horizontal frictional load F'a and F"a induced on the tie rod 47 by the incremental outward movement of the tensile inclusion material is small because the coefficient of friction between the tensile inclusion material and the tie rod 47 is low compared to the coefficient of friction between the adjacent layers of the confined fill layers. The rear plate 61 is sized in the individual wall design to have sufficient area to restrain the frictional horizontal loads F'a and F"a induced on the tie rod 47. Also the length of the tie rod 47 behind the assumed failure plane 280 are taken into account in the calculation to determine the size of the rear plate. Therefore, with the proper design of the tie rod 47 length and the area of the rear plate 61, the confined fill layers of the MSE wall 8 can creep or become displaced horizontally with respect to the stable position of the rear plate 61.

Another important factor in overall wall stability determination is the effect of seismic loading on the wall components. The major area of concern is overall wall structural stability which, if required for a particular wall design, is calculated for the entire MSE wall 8. Since the full height facing panels 30 are not in contact with the separate MSE wall 8, the induced horizontal acceleration loads of the facing elements 30, 130, or 250 (depending on the embodiment) is addressed in the strength design of the upper tie rod/plate assembly 42. Local seismic codes vary and typically a horizontal acceleration factor is applied to upper tie rod assembly 42 that could be induced by an earth wave in a seismic event on the facing panel. As the height of wall increases or if the structure is located in area of high seismic risk, the ultimate load assumption on the tie rod may increase. In order to maintain a rear plate 61 minimum area, the number of tie rods 47 can be increased or the width of the facing panels can be decreased as horizontal loads are increased on the tie rod assemblies. Since thin section, non-bearing, facing panels are used for the face of the separate MSE wall 8 for the present invention the weight (mass) of the panels are low compared to those of facing elements that are used for other retaining wall products currently available. The lower weight of these panels result in the minimum number of tie rods 47 with a corresponding minimum tie rod diameter 87. Correspondingly the plate strength and area is also at a minimum. This efficient use of material result in a more competitive cost for the materials of the present invention compared to the component costs for by retaining wall systems currently in use.

While this invention has been described and illustrated with reference to preferred embodiments, it is recognized that variations and changes may be made therein, without departing from the invention as set forth in the claims. It is intended therefore that the following claims include such alternate embodiments.

What is claimed is:

1. A retaining wall system comprising:

a mechanically stabilized earth backfill having confined layers:

an assembly of full height, rigid fascia panels;

a separate foundation to support said fascia panels;

anchors embedded in said mechanically stabilized earth backfill;

adjustable attachment points connected to said fascia panels for horizontal, vertical and plumb adjustment of said fascia panels;

tie rods attached to said adjustable attachment points on said fascia panels for anchoring said fascia panels to said anchors;

sleeves surrounding said tie rods to allow movement between said tie rods and said mechanically stabilized earth backfill;

a void separating said fascia panels from said mechanically stabilized earth backfill; and a closure beam at the top of said void.

2. The system of claim 1 wherein said mechanically stabilized earth backfill has a top most layer offset with respect to the other layers of said mechanically stabilized earth backfill, said offset creating a ledge for placement of said closure beam.

3. A retaining wall system comprising:

a mechanically stabilized earth backfill having a base, intermediate layers and an uppermost layer;

an assembly of full height, rigid fascia panels, each of said fascia panels having a lower edge;

a separate elevated foundation to support said fascia panels, said foundation having a notch for receiving said fascia panel lower edges;

anchors embedded in said mechanically stabilized earth backfill;

tie-rods attached to said anchors, said tie rods being embedded in said mechanically stabilized earth backfill, and said tie rods connecting said fascia panels to said anchors and said foundation to said anchors;

sleeves surrounding said tie-rods to allow limited vertical movement between said fascia panels and said mechanical stabilized earth backfill;

adjustment mechanisms connecting said fascia panels to said tie-rods and providing vertical, horizontal, and plumb alignment of said fascia panels;

a void separating said fascia panels from said mechanically stabilized earth backfill; and a closure beam placed at the uppermost layer of said mechanically stabilized earth backfill to maintain said void between said fascia panels and said mechanically stabilized earth backfill.

4. The system of claim 3 wherein said fascia panels comprise:

precast concrete fascia panels having prepositioned adjustable attachment points cast into said fascia panels during manufacture.

5. The system of claim 3 wherein said foundation comprises:

separate pedestals placed to support said fascia panels, said pedestals having notches to receive the lower edges of said fascia panels.

6. The system of claim 3 wherein the lower edges of said fascia panels are elevated with respect to the base of said mechanically stabilized earth backfill.

7. The system of claim 3 wherein said foundation comprises:

a continuous, foundation beam.

8. The system of claim 3 wherein said adjustment mechanisms can be accessed for adjustment from the outside of said retaining wall system.

9. A method of constructing a retaining wall comprising:

forming a mechanically stabilized earth backfill having layers, including a base and a top most layer;

embedding lower tie rod assemblies between designated layers of said mechanically stabilized earth backfill;

constructing a separate foundation to support an assembly of full height rigid fascia panels, said fascia panels having a face side;

providing an elevated work platform at designated elevations within said mechanically stabilized earth backfill to facilitate attachment of tie-rods to said fascia panels;

embedding upper tie rod assemblies between designated layers of said mechanically stabilized earth backfill;

connecting said fascia panels to said foundation;

connecting said fascia panels to said upper tie rod assemblies using said elevated work platform;

aligning said fascia panels using adjustable tie-rod to panel connection mechanisms that allow vertical, horizontal and plumb alignment of said fascia panels; and providing a void between said fascia panels and said mechanically stabilized earth backfill with a closure beam placed at the top most layer of said mechanically stabilized earth backfill.

10. The method of claim 9 further comprising:

elevating said foundation relative to the base of said mechanically stabilized earth backfill.

11. The method of claim 9 further comprising:

providing access to said adjustable tie-rod to panel connection mechanisms from the face side of said fascia panels.

12. A retaining wall facing system comprising:

an elevated, remote foundation;

an assembly of facing panels, each panel having a top edge, a bottom edge, a front side, a back side, and attachments points on the back side of said facing panels;

substantially vertical T-shaped columns to laterally constrain said facing panels;

spacer blocks positioned beneath said facing panels for horizontal adjustment of said fascia panels;

a separate layered, confined mechanically stabilized earth structure having a base;

tie rods embedded in said mechanically stabilized earth wall structure and mechanically connecting said columns to said mechanically stabilized earth structure;

low friction sleeves placed a round said tie rods to allow free movement between said tie rods and said mechanically stabilized earth structure;

anchors embedded in said mechanically stabilized earth structure to mechanically connect said columns to said mechanically stabilized earth structure;

a void separating said facing panels from said mechanically stabilized earth structure; and a closure beam placed at the uppermost layer of said mechanically stabilized earth structure to maintain said void between said assembly of facing panels and said mechanically stabilized earth structure.

13. The system of claim 12 wherein said foundation comprises individually flanged, elevated, concrete panel support pedestals.

14. The system of claim 12 wherein said facing panels are:

precast concrete facing panels having prepositioned adjustable attachment points cast into said facing panels during manufacture.

15. The system of claim 12 wherein said foundation comprises:

separate precast concrete pedestals placed to underpin said facing panels.

16. The system of claim 15 wherein said concrete pedestals are elevated with respect to the base of said mechanically stabilized earth structure.

17. The system of claim 12 wherein said foundation comprises:

a continuous foundation beam to which said facing panels are mechanically attached.

18. The system of claim 12, wherein said adjustment mechanisms can be accessed for adjustment from the front side of said facing panels.

19. A retaining wall system, comprising:

a separate, layered mechanically stabilized earth structure having a base and an uppermost layer;

an assembly of fascia panels, each panel having a top edge, a bottom edge, sides, a front side, a back side, notches at the bottom corners, and having prepositioned adjustable attachments points on the back side of said panels;

an elevated, remote, foundation to support said fascia panels;

anchors embedded in said mechanically stabilized earth structure tie rods embedded in said mechanically stabilized earth structure and mechanically connecting said fascia panels to said anchors;

low friction sleeves placed around said tie rods to allow movement between said tie rods and said mechanically stabilized earth structure;

a void separating said fascia panels from said mechanically stabilized earth structure; and a closure beam placed at the uppermost layer of said mechanically stabilized earth structure to maintain said void between said fascia panels and said mechanically stabilized earth structure.

20. The system of claim 19 wherein said fascia panels have a generally parallelogram shape with a rectangular cross section and said fascia panels include imbedded inserts for panel connection.

21. The system of claim 19 wherein said notches in said fascia panels have sufficient width for insertion of tie rods therethrough.

22. The system of claim 21 wherein said tie-rods extend beyond the front sides of said fascia panels.

23. The system of claim 19 wherein said foundation is cast in place on top of an offset layer of said mechanically stabilized earth structure.

24. The system of claim 23 wherein said foundation is elevated with respect to said base of said mechanically stabilized earth structure.

25. The system of claim 19 wherein said foundation comprises separate precast concrete pedestals.

26. The system of claim 25 wherein said concrete pedestals are elevated with respect to the base of said mechanically stabilized earth structure.

* * * * *